US010005284B2

(12) United States Patent
Suzuki et al.

(10) Patent No.: US 10,005,284 B2
(45) **Date of Patent: *Jun. 26, 2018**

(54) LIQUID EJECTING APPARATUS AND CLEANING DEVICE

(71) Applicant: SEIKO EPSON CORPORATION, Tokyo (JP)

(72) Inventors: Shigeki Suzuki, Shiojiri (JP); Koji Harada, Shiojiri (JP); Tsuyoshi Hayashi, Shiojiri (JP); Kazuhiko Hara, Shiojiri (JP); Yasunori Koike, Matsumoto (JP); Ryo Oguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/723,325

(22) Filed: Oct. 3, 2017

(65) Prior Publication Data

US 2018/0037030 A1 Feb. 8, 2018

Related U.S. Application Data

(63) Continuation of application No. 15/238,081, filed on Aug. 16, 2016, now Pat. No. 9,809,029.

(30) Foreign Application Priority Data

Sep. 18, 2015 (JP) ..... 2015-185755

(51) Int. Cl.
*B41J 2/165* (2006.01)

(52) U.S. Cl.
CPC ..... *B41J 2/16505* (2013.01); *B41J 2/165* (2013.01); *B41J 2/16544* (2013.01); *B41J 2/16585* (2013.01); *B41J 2002/1655* (2013.01)

(58) Field of Classification Search
CPC .... B41J 2/16505; B41J 2/16544; B41J 2/165; B41J 2/16585; B41J 2002/1655
See application file for complete search history.

(56) References Cited

U.S. PATENT DOCUMENTS 9,809,029 B2 * 11/2017 Suzuki ..... B41J 2/16505
2005/0156995 A1 7/2005 Nishino
(Continued)

FOREIGN PATENT DOCUMENTS

EP 1557270 7/2005
JP 2005205631 8/2005
(Continued)

OTHER PUBLICATIONS

Office Action issued in U.S. Appl. No. 15/238,081 dated Jan. 9, 2017.

(Continued)

*Primary Examiner* — Henok Legesse
(74) *Attorney, Agent, or Firm* — Workman Nydegger

(57) ABSTRACT

A liquid ejecting apparatus includes a liquid ejecting head which ejects liquid from a nozzle that is disposed on a nozzle surface, and an absorption member which is able to contact the nozzle surface, in which it is possible to perform a first contact operation which causes the absorption member to contact the nozzle surface at a position which corresponds to a nozzle region that includes an opening region of the nozzle, and a second contact operation which causes the absorption member to contact the nozzle surface at a position which corresponds to a non-nozzle region that is a region outside of the nozzle region.

13 Claims, 11 Drawing Sheets

(56) References Cited

U.S. PATENT DOCUMENTS

| | | | |
|---|---|---|---|
| 2010/0201738 | A1 | 8/2010 | Yamaguchi et al. |
| 2012/0050403 | A1 | 3/2012 | Inoue |
| 2014/0125734 | A1 | 5/2014 | Kobayashi |
| 2014/0152740 | A1* | 6/2014 | Yoshino ..... B41J 2/16535 347/31 |
| 2017/0080714 | A1 | 3/2017 | Suzuki et al. |

FOREIGN PATENT DOCUMENTS

| | | |
|---|---|---|
| JP | 2008229962 | 10/2008 |
| JP | 2011067985 | 4/2011 |
| JP | 2012051184 | 3/2012 |
| JP | 2014069309 | 4/2014 |
| JP | 2014091319 | 5/2014 |
| JP | 2014108594 | 6/2014 |

OTHER PUBLICATIONS

Notice of Allowance issued in U.S. Appl. No. 15/238,081 dated Jul. 5, 2017.

European Search Report for Application No. 16185998.8 dated Dec. 14, 2016.

* cited by examiner

LIQUID EJECTING APPARATUS AND CLEANING DEVICE

BACKGROUND

1. Technical Field

The present invention relates to a liquid ejecting apparatus such as an ink jet printer, and a cleaning device.

2. Related Art

From the related art, as a type of liquid ejecting apparatus, an ink jet printer is known which performs printing by discharging ink from an ink discharge opening of a nozzle which is formed on an ink discharge surface of a recording head on a paper sheet. In such a printer, a head maintenance device is provided which wipes the ink discharge surface using an ink absorption member with a long sheet shape (for example, refer to JP-A-2008-229962).

Such a head maintenance device is provided with an ink absorption member which absorbs ink and a pressing member which is caused to contact the ink discharge surface due to the ink absorption member pressing from the opposite side from the side that contacts the ink discharge surface. The pressing member is provided with a roller member which has a groove portion on a contact surface with the ink absorption member formed by an elastic member and is configured to freely rotate, and a shaft member which axially supports the roller member.

Then, wiping of ink from the entire surface of the ink discharge surface is performed by moving the roller member to another end portion of the ink discharge surface in a state where the ink absorption member is caused to adhere to one end portion of the ink discharge surface by pressing the ink absorption member from the opposite side from the side that contacts the ink discharge surface of a recording head using the roller member. In this case, the groove portion of the roller member is disposed to avoid a position which corresponds to the ink discharge opening of the nozzle.

Here, in a head maintenance device of a printer as described above, in a case where there is unevenness (level difference) on the ink discharge surface, there is a problem in that when pressing force increases on the ink absorption member of the roller member that is to increase wiping away of ink on the ink discharge surface, the ink discharge surface receives damage and tends to deteriorate. In this case, since the groove portion of the roller member is disposed to avoid the position which corresponds to the ink discharge opening, pressing force, which is applied on an ink discharge opening peripheral region that includes the ink discharge opening region on the ink discharge surface, increases and the region particularly tends to deteriorate.

Note that, such a problem is not limited to an ink jet printer which performs printing by ejecting ink from the nozzle, and is generally common in a liquid ejecting apparatus which is provided with a head maintenance device that wipes liquid which is adhered to the nozzle surface while pressing a liquid absorption member with a sheet shape using an elastic body such as rubber on the nozzle surface on which the nozzle is disposed.

SUMMARY

An advantage of some aspects of the invention is to provide a liquid ejecting apparatus and a cleaning device in which it is possible to suppress deterioration of a nozzle region which includes an opening region of the nozzle by wiping a nozzle surface on which the nozzle that ejects liquid is disposed.

Hereinafter, means of the invention and operation effects thereof will be described.

According to an aspect of the invention, there is provided a liquid ejecting apparatus including a liquid ejecting head which ejects liquid from a nozzle that is disposed on a nozzle surface, an absorption member which is able to absorb the liquid which is adhered to the nozzle surface by contacting the nozzle surface, and a pressing portion which presses the absorption member from the opposite side from the side that contacts the nozzle surface in the absorption member and causes the absorption member to contact the nozzle surface, in which it is possible to perform a first contact operation which causes the absorption member that is pressed by the pressing portion to contact the nozzle surface at a position which corresponds to a nozzle region that includes an opening region of the nozzle on the nozzle surface, and a second contact operation which causes the absorption member that is pressed by the pressing portion to contact the nozzle surface at a position which corresponds to a non-nozzle region that is a region outside of the nozzle region on the nozzle surface.

According to this configuration, it is possible to perform wiping of the nozzle surface while reducing pressing force which is applied to the nozzle region due to wiping in particular, by selectively performing wiping of the nozzle surface due to the contact with the absorption member by the second contact operation. Accordingly, it is possible to suppress deterioration of the nozzle region which includes the opening region of the nozzle by wiping a nozzle surface on which the nozzle that ejects liquid is disposed.

In the liquid ejecting apparatus, in the contact with the absorption member due to the second contact operation, it is preferable that the pressing force which is applied to the nozzle region due to the contact with the absorption member is smaller than pressing force which is applied to the non-nozzle region due to contact with the absorption member.

According to this configuration, it is possible to appropriately absorb and remove liquid which is adhered to the nozzle surface while reducing damage that is applied to the nozzle region using the absorption member.

In the liquid ejecting apparatus, it is preferable that compressibility of a part which is pressed on the nozzle region in the absorption member is smaller than compressibility of the part which is pressed on the non-nozzle region in the absorption member.

According to this configuration, it is possible to appropriately absorb and remove liquid which is adhered to the nozzle surface while reducing damage that is applied to the nozzle region using the absorption member.

In the liquid ejecting apparatus, the non-nozzle region is a protrusion surface which protrudes more than the nozzle region, and the protrusion surface has a lower liquid repellence than the nozzle region.

According to this configuration, it is possible to absorb and remove liquid on the protrusion surface efficiently using the absorption member since the liquid tends to wet the protrusion surface on which liquid repellence is relatively low.

In the liquid ejecting apparatus, it is preferable that the non-nozzle region is the protrusion surface which protrudes more than the nozzle region, a last region which is a region in which the absorption member is lastly contacted on the nozzle surface is configured by the protrusion surface in a wiping operation in which the absorption member is moved relatively to the liquid ejecting head in a direction along the nozzle surface in a state where the absorption member contacts the nozzle surface, and in the contact with the absorption member due to the second contact operation, pressing force which is applied to the last region is larger than pressing force which is applied to the nozzle region when the absorption member contacts both of the nozzle region and the protrusion surface.

According to this configuration, when changing from a state in which the absorption member contacts both of the protrusion surface and the nozzle region to a state of contacting only the protrusion surface of the last region, pressure on a part which contacts the nozzle region in the absorption member rises. For this reason, it is possible to suppress liquid remaining after wiping by the absorption member on the protrusion surface of the last region.

In the liquid ejecting apparatus, it is preferable that a surface of the nozzle on the liquid ejecting head is covered by a cover member that has a through hole that exposes the nozzle region in a part that corresponds to the nozzle region.

According to this configuration, it is possible to apply pressing forces which are different from each other respectively in the nozzle region and the non-nozzle region during wiping of the nozzle surface with a relatively simple configuration in which the cover member is attached to the liquid ejecting head.

In the liquid ejecting apparatus, it is preferable that the pressing portion has a convex portion that is able to press the absorption member, and a dimension of the convex portion in a direction that intersects with a direction in which the absorption member is moved relatively to the liquid ejecting head in a direction along the nozzle surface in a state of contacting the nozzle surface is shorter than a dimension of the nozzle region in the intersecting direction.

According to this configuration, it is possible to effectively press the absorption member using the convex portion of the pressing portion such that the absorption member appropriately contacts the nozzle region.

According to another aspect of the invention, there is provided a cleaning device including an absorption member which is able to absorb the liquid which is adhered to the nozzle surface by contacting the nozzle surface of a liquid ejecting head which ejects liquid from a nozzle that is disposed on a nozzle surface, and a pressing portion which presses the absorption member from the opposite side from the side that contacts the nozzle surface in the absorption member and causes the absorption member to contact the nozzle surface, in which it is possible to perform a first contact operation which causes the absorption member that is pressed by the pressing portion to contact the nozzle surface at a position which corresponds to a nozzle region that includes an opening region of the nozzle on the nozzle surface, and a second contact operation which causes the absorption member that is pressed by the pressing portion to contact the nozzle surface at a position which corresponds to a non-nozzle region that is a region outside of the nozzle region on the nozzle surface.

According to this configuration, it is possible to perform wiping of the nozzle surface while reducing pressing force which is applied to the nozzle region due to the wiping in particular, by selectively performing wiping of the nozzle surface by the second contact operation. Accordingly, it is possible to suppress deterioration of the nozzle region which includes the opening region of the nozzle by wiping a nozzle surface on which the nozzle that ejects liquid is disposed.

BRIEF DESCRIPTION OF THE DRAWINGS

The invention will be described with reference to the accompanying drawings, wherein like numbers reference like elements.

DESCRIPTION OF EXEMPLARY EMBODIMENTS

A first embodiment of a liquid ejecting apparatus is described below with reference to the accompanying drawings.

Figure 1:
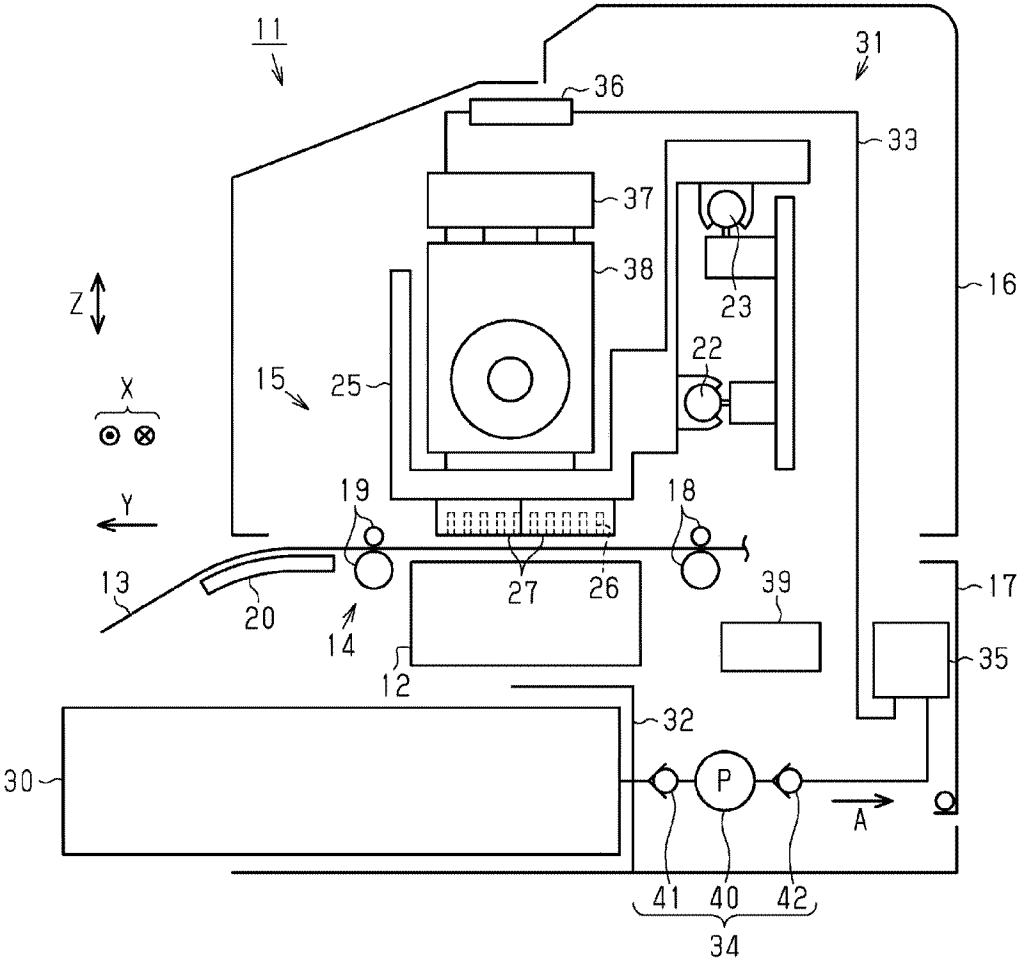
FIG. 1 is a schematic view illustrating a schematic configuration of an ink jet printer of a first embodiment.

As shown in FIG. 1, an ink jet printer 11 as an example of a liquid ejecting apparatus is provided with a transport portion 14 which transports a recording medium 13 such as a paper sheet that is supported on a support base 12 in a transport direction Y along a front surface of the support base 12 and a printing portion 15 which performs printing by ejecting ink as an example of liquid on the transported recording medium 13.

The support base 12, the transport portion 14, and the printing portion 15 are assembled on a printer main body 16 which is configured by a housing, a frame, and the like. In the ink jet printer 11, the support base 12 extends in a width direction of the recording medium 13 (direction orthogonal to a paper surface in FIG. 1). In addition, a cover 17 is attached to the printer main body 16 so as to be able to be opened and closed.

The transport portion 14 is provided with a pair of transport rollers 18 and 19 which are respectively disposed on an upstream side and a downstream side of the support base 12 in the transport direction Y and a guide plate 20 which guides while supporting the recording medium 13 by disposing on the downstream side of the pair of transport rollers 19 in the transport direction Y. Then, the transport portion 14 transports the recording medium 13 in the transport direction Y along the front surface of the support base 12 and the front surface of the guide plate 20 by rotating while interposing the recording medium 13 by the pair of transport rollers 18 and 19 driving a transport motor (illustration omitted).

The printing portion 15 is provided with guide shafts 22 and 23 which extend along a scanning direction X that is a width direction of the recording medium 13 that is orthogonal to (intersects with) the transport direction Y of the recording medium 13 and a carriage 25 that is able to reciprocally move in the scanning direction X by being guided on the guide shafts 22 and 23. The carriage 25 reciprocally moves in the scanning direction X accompanying driving of a carriage motor 24 (refer to FIG. 2).

At least one (two in the embodiment) liquid ejecting head 27 that has the nozzle 26 which ejects ink is attached to a lower end portion of the carriage 25. That is, the liquid ejecting head 27 is attached to the carriage 25 at a posture with a lower surface placed facing a predetermined gap to the support base 12 in a vertical direction Z, and is reciprocally moved in the scanning direction X along with the carriage 25 accompanying driving of the carriage motor 24 (refer to FIG. 2). Each liquid ejecting head 27 is separated by a predetermined distance in the scanning direction X, and disposed so as to be deviated by a predetermined distance in the transport direction Y.

Meanwhile, a part of a supply mechanism 31 which supplies ink to the liquid ejecting head 27 from an ink cartridge 30 is attached to the upper side of the carriage 25. The supply mechanism 31 causes ink to flow along a supply direction A from the upstream side which is the ink cartridge 30 side toward the downstream side which is the liquid ejecting head 27 side. The ink cartridge 30 and the supply mechanism 31 are provided with at least one set (five sets in the embodiment) of each type of ink.

Five ink cartridges 30 are respectively mounted so as to freely attach and detach a plurality (five in the embodiment) of mounting portions 32, and accommodate respectively different colors (types) of ink. For example, each color of ink of cyan (C), magenta (M), yellow (Y), black (K), and white (W) are accommodated in each ink cartridge 30. Color printing and the like is performed on the recording medium 13 by ejecting ink which is supplied from each ink cartridge 30 from the liquid ejecting head 27. For example, in a case of a dark color recording medium 13, color printing is performed thereon after white printing (foundation printing) is performed.

The supply mechanism 31 is provided with a supply path 33 which supplies ink to the liquid ejecting head 27 from the ink cartridge 30. A supply pump 34 which causes ink to flow in the supply direction A, a filter unit 35 which captures air bubbles or foreign matter within ink, a static mixer 36 which stirs ink by changing flow of ink which flows along the supply path 33, a liquid retaining chamber 37 which retains ink, and a pressure adjustment unit 38 which adjusts ink pressure are provided in order from the upstream side on the supply path 33.

The supply pump 34 has a diaphragm pump 40 in which a pump chamber capacity is variable, an inlet valve 41 which is disposed further on the upstream side than the diaphragm pump 40, and a discharge valve 42 which is disposed further on the downstream side than the diaphragm pump 40. The inlet valve 41 and the discharge valve 42 permit ink flow to the downstream side, and are configured by a one direction valve which prohibits ink flow to the upstream side.

For this reason, the supply pump 34 suctions ink via the inlet valve 41 from the ink cartridge 30 side accompanying an increase in capacity of the pump chamber of the diaphragm pump 40 and discharges ink via the discharge valve 42 to the liquid ejecting head 27 accompanying a reduction of capacity of the pump chamber. In addition, the filter unit 35 is disposed at a position which corresponds to the cover 17 of the printer main body 16, and is mounted so as to be attachable and detachable with respect to the supply path 33. Then, the filter unit 35 is replaceable by opening the cover 17.

Note that, the ink jet printer 11 is provided with a control portion 39 which performs driving control of a transport motor (illustration omitted) which drives the pair of transport rollers 18 and 19, the carriage motor 24 (refer to FIG. 2), the supply pump 34, and the like, ejection control of ink from each nozzle 26 of the liquid ejecting head 27, and the like. Then, the liquid ejecting head 27 performs printing by ejecting ink on the recording medium 13 which is transported on the support base 12 from each nozzle 26 while reciprocally moving in the scanning direction X along with the carriage 25 accompanying driving of the carriage motor 24.

Figure 2:
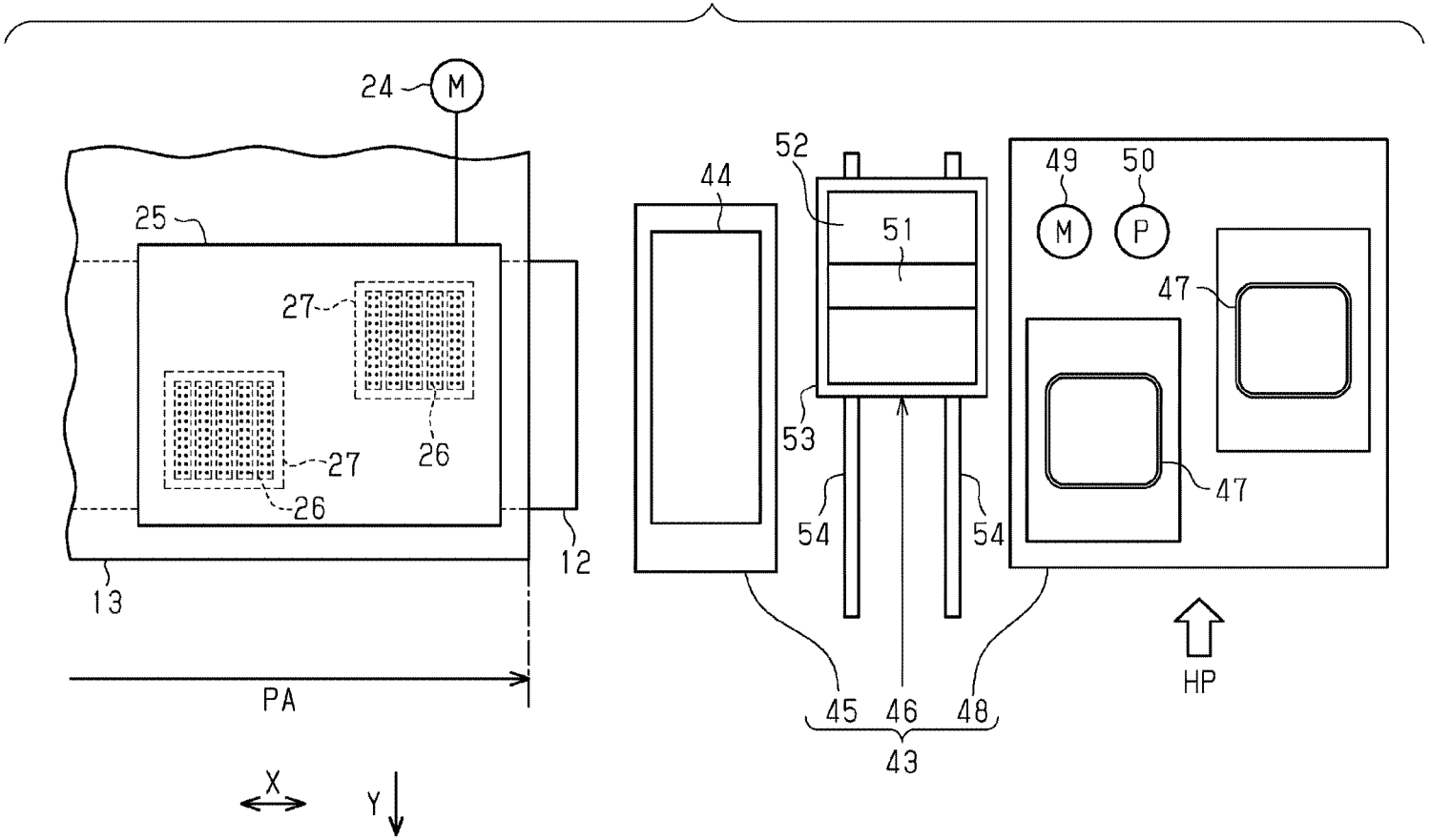
FIG. 2 is a schematic plan view illustrating a positional relationship of a support base and a maintenance mechanism.

As shown in FIG. 2, the maintenance mechanism 43 for performing maintenance of the liquid ejecting head 27 is provided at a position adjacent to one end of the support base 12 in the scanning direction X. In the embodiment, a region in which there is a possibility that the recording medium 13 is transported that is a region in which ink is ejected on the recording medium 13 in order for the liquid ejecting head 27 to print is a transport region PA. In this case, the maintenance mechanism 43 is disposed outside (right side in FIG. 2) of the transport region PA that is within a scanning range of the carriage 25 in the scanning direction X.

The maintenance mechanism 43 is provided with a flushing unit 45 that has a liquid receiving portion 44, a wiper unit 46 as an example of the cleaning device, and a capping unit 48 that has two cap portions 47 that have a bottomed rectangular box shape in which the upper end is open, disposed lined up in order from a position that is close to the transport region PA in the scanning direction X.

The carriage 25 and the liquid ejecting head 27 are in standby at a home position HP at which the capping unit 48 is disposed when printing is not performed, when the power is turned off, or the like. That is, the liquid ejecting head 27 is movable between the transport region PA and the home position HP in the scanning direction X which is orthogonal to (intersects with) the transport direction Y.

When two liquid ejecting heads 27 are moved to the home position HP, two cap portions 47 respectively face two liquid ejecting heads 27 in an up and down direction. Each cap portion 47 is raised and lowered between a position at which it is possible to contact each liquid ejecting head 27 and a position which is separated from each liquid ejecting head 27 by driving of a capping motor 49.

Each cap portion 47 suppresses drying of ink within each nozzle 26 by performing capping which forms a closed space at each liquid ejecting head 27 by contacting each liquid ejecting head 27 so as to surround a plurality of nozzles 26. Each liquid ejecting head 27 is capped by each cap portion 47 at the home position HP when printing is not performed and the like.

Within each cap portion 47, it is possible to suction using a suction pump 50 via a suction tube (illustration omitted) to which one end side is connected to each cap portion 47. Then, in a state in which each liquid ejecting head 27 is capped by each cap portion 47 at the home position HP, thickening of ink, air bubbles, and the like within each liquid ejecting head 27 are discharged within each cap portion 47 from each nozzle 26, so-called head cleaning is performed by suctioning within each cap portion 47 (closed space) by driving the suction pump 50. Note that, the capping motor 49 and the suction pump 50 are driven and controlled by the control portion 39 (refer to FIG. 1).

The wiper unit 46 is provided with a wiper cassette 52 in which a cloth sheet 51 is mounted as an example of the absorption member that is able to absorb ink by abutting on the lower surface of the liquid ejecting head 27 and a wiper holder 53 with a bottomed rectangular box shape to which an upper end is open to which the wiper cassette 52 is mounted so as to freely attach and detach. The wiper unit 46 is guided to be able to be reciprocally moved along the transport direction Y using a pair of rail portions 54.

In addition, the flushing unit 45 discharges an ink droplet from each nozzle 26 unrelated to printing with the object of preventing or eliminating clogging or the like of each nozzle 26, and receives flushing ink which is discharged when so-called flushing is performed in a liquid receiving portion 44. Note that, the flushing unit 45 is disposed so as to be positioned below the liquid ejecting head 27 at the left side at which the liquid receiving portion 44 is in FIG. 2 when the liquid ejecting head 27 on the right side in FIG. 2 is positioned above the wiper unit 46.

Figure 3:
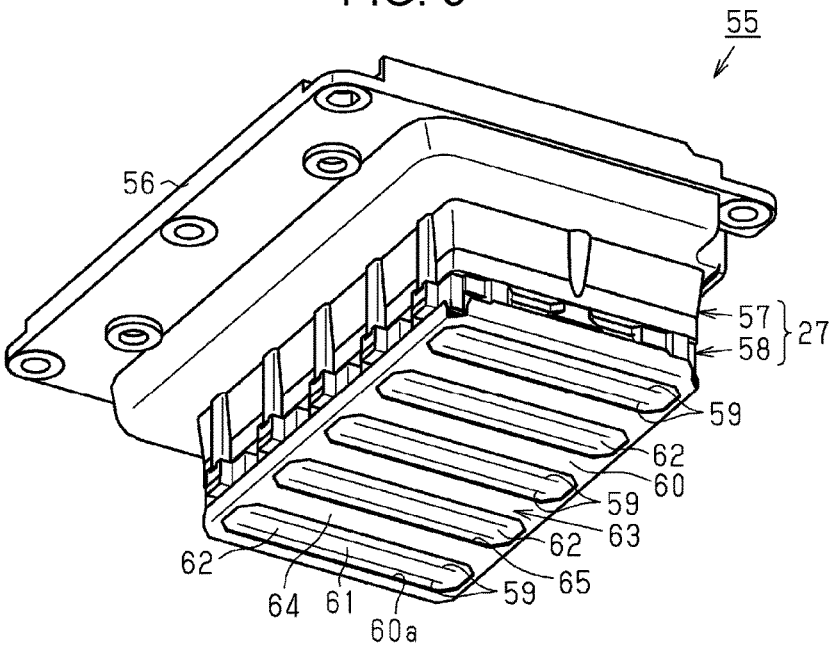
FIG. 3 is a perspective view of a head unit.

As shown in FIG. 3, since the head unit 55 is attached to a lower surface portion of the carriage 25, the head unit 55 is provided with a bracket portion 56 for attaching to the carriage 25 and the liquid ejecting head 27 with a rectangular cube shape which protrudes down from the bracket portion 56. The liquid ejecting head 27 is provided with a flow path forming portion 57 with a rectangular cube shape which protrudes down from the bracket portion 56 and a head main body 58 with a rectangular shape which is fixed to the lower side of the flow path forming portion 57. A plurality of rows (for example, 10 rows) of nozzle rows 59 are formed on the lower surface of the head main body 58 in FIG. 3.

In addition, a cover member 60 with a plate shape that has a plurality of (for example, five) through holes 60*a* is attached to the lower surface side of the head main body 58 so as to cover a portion of a nozzle opening surface 61 (lower surface in the present example) to which each nozzle 26 (refer to FIG. 4) that configures the nozzle row 59 is open. The plurality of nozzle rows 59 are exposed by a predetermined row number (for example, two rows) in one through hole 60*a*. Of course, the through hole 60*a* may be provided in each one row of the nozzle row 59.

In the present example, a region which is exposed by a through hole 60*a* on the nozzle opening surface 61 is a nozzle region 62. That is, a surface of the nozzle 26 on the liquid ejecting head 27 is covered by the cover member 60 that has the through hole 60*a* that exposes the nozzle region 62 in a part that corresponds to the nozzle region 62 that is a region adjacently outside the opening region of the nozzle 26. Note that, the opening region of each nozzle 26 (refer to FIG. 4) is included in the nozzle region 62.

Figure 4:
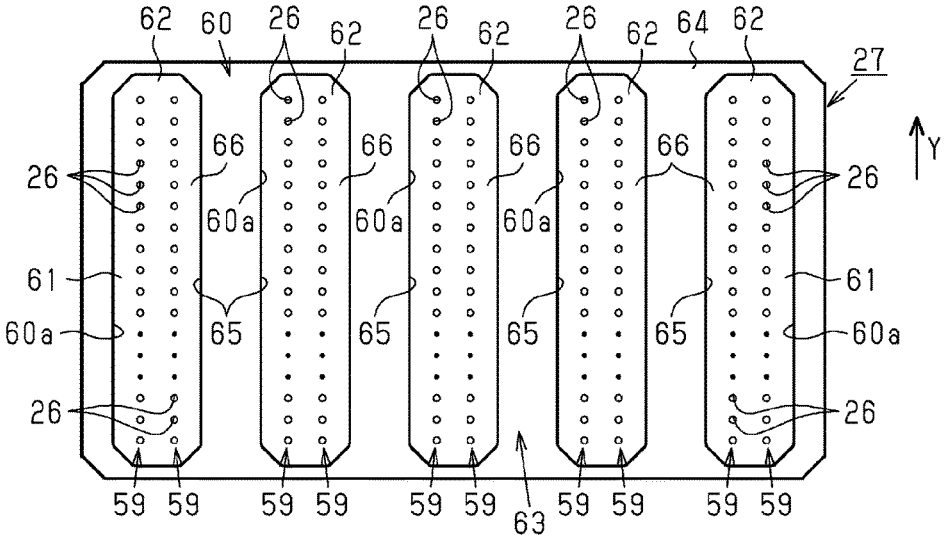
FIG. 4 is a schematic view of the nozzle surface.
Figure 5:
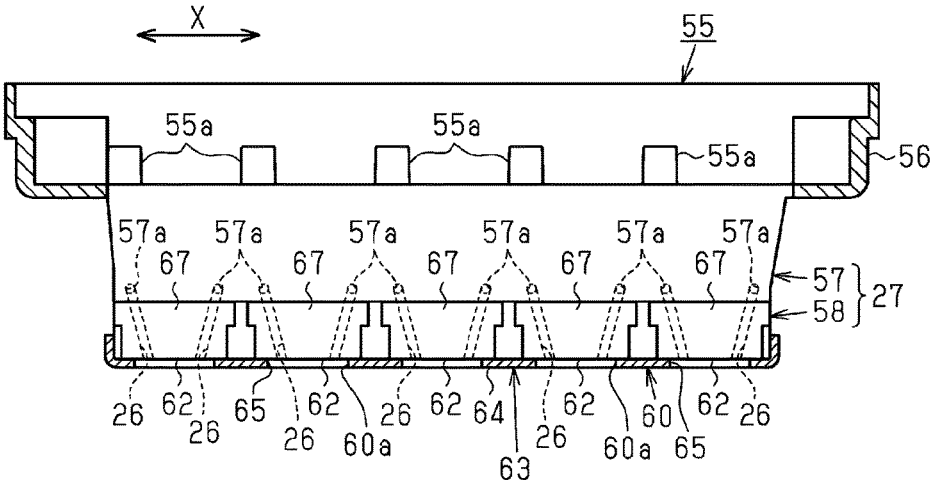
FIG. 5 is a schematic sectional view of FIG. 3.

As shown in FIGS. 4 and 5, the cover member 60 is fixed to the liquid ejecting head 27 using a fixing structure such as a lock in a state in which the cover member 60 covers a part outside of the nozzle region 62 which is exposed by the through hole 60*a* on the nozzle opening surface 61. Then, as shown in FIG. 3, the entire bottom surface of the liquid ejecting head 27 is a nozzle surface 63 that is a wiping target of the wiper unit 46. The nozzle surface 63 is provided with the nozzle region 62 (that is, a region within the through hole 60*a*), and a protrusion surface 64 which is a non-nozzle region that is a region outside of the nozzle region 62 and protrudes more than the nozzle region 62 by only a thickness (0.1 mm in the example) of the cover member 60.

Accordingly, a step 65 is present between the nozzle region 62 and the protrusion surface 64 (non-nozzle region). That is, the nozzle surface 63 is configured by an uneven surface which is a concave portion at a part of the nozzle region 62 and a convex portion at a part of the protrusion surface 64. Note that, the cover member 60 is configured by, for example, metal (for example, stainless steel or the like) and the like.

As shown in FIG. 4, the nozzle row 59 is formed of multiple (for example, 180 or 360) nozzles 26 which are disposed at a constant pitch along the transport direction Y. Each nozzle row 59 respectively ejects ink of one color which corresponds to the ink color of the ink cartridge 30 (refer to FIG. 1). Of course, ink of a color other than the four colors of CMYK, and white (W) may be ejected, and for example, ink of color such as light magenta, light cyan, light yellow, gray, and orange may be ejected. In addition, the color number of the liquid ejecting head 27 may be CMYK 4 colors, CMY 3 colors, black 1 color, and the like. Furthermore, there may be unused nozzle rows which do not eject ink within the plurality of nozzle rows 59.

In addition, a liquid repelling treatment in which ink is easily repelled (ink repellent treatment) is carried out on the nozzle opening surface 61 and a liquid repellent film 66 (ink repellent film) is deposited on the front surface of the nozzle opening surface 61. Ink that is used in the embodiment is, for example, pigment ink. In the pigment ink, particles of multiple pigments are dispersed within the liquid that is used as a dispersion medium. Organic pigments with an average particle diameter of approximately 100 nm as the pigments of cyan, magenta, and yellow, carbon black (inorganic pigments) with average particle diameter of approximately 120 nm as the black pigment, titanium oxide (inorganic pigments) with average particle diameter of approximately 320 nm as the white pigment, and the like may be used.

Ink in the present example is water-based ink, and particles of multiple pigments are dispersed within water that is the dispersion medium. For this reason, in the example, the liquid repellent film 66 is a water repellent film having a function to repel water-based ink. The liquid repellent film 66 may be configured from a thin film under layer that has, for example, a polyorganosiloxane containing an alkyl group as a main material and a liquid repellent film layer that is formed of a metal alkoxide that has a long-chain polymer group containing fluorine. The liquid repellent film 66 is gradually worn due to wiping with respect to the nozzle opening surface 61 being repeatedly performed, and when the liquid repellent film 66 is worn by a certain amount or more, liquid repellence is lowered. Note that, the liquid repellent film 66 may be a liquid-repellent coating film and may be a monomolecular film with liquid repellence, and it is possible to arbitrarily select the film thickness and liquid repellent treatment method thereof.

In a state in which liquid repellence of the liquid repellent film 66 is lowered, a wetting angle (contact angle) of liquid such as ink mist is reduced in the nozzle region 62. For this reason, a plurality of ink mists which are adhered in the nozzle region 62 tend to spread and one ink droplet (adhered ink) develops relatively widely. For this reason, there is a concern that such adhered ink is present in the vicinity of the nozzle 26, an opening of a part of the nozzle 26 is blocked, and furthermore, flows within the nozzle 26.

In addition, when the ink droplet is ejected from the nozzle 26 in a state in which the adhered ink is present in the vicinity of the nozzle 26, the ejected ink droplet contacts the adhered ink, and curved flight of the ink droplet is caused. Such curved flight of the ink droplet leads to lowering of printing quality caused by deviation of a landing position (that is, printing dot formation position) of the ink droplet on the recording medium 13 from an assumed position. As a result, it is necessary to suppress as much as possible wear on the liquid repellent film 66 due to wiping.

Meanwhile, the cover member 60 is manufactured such that a metal plate is processed in a predetermined shape, and liquid repellent treatment is not carried out on the front surface of the cover member 60. For this reason, the protrusion surface 64 (non-nozzle region) has a lower liquid repellence than the nozzle region 62. That is, a wetting angle of ink with respect to the protrusion surface 64 is smaller than a wetting angle of ink with respect to the nozzle region 62.

As shown in FIG. 5, the liquid ejecting head 27 has a plurality (for example five in the embodiment) of recording heads 67 (unit heads) that are arranged in parallel at a constant pitch in the scanning direction X. A peripheral edge portion of the nozzle opening surface 61 which is the lower surface of the recording head 67 is covered by the cover member 60, and the nozzle region 62 which includes two rows of nozzles 26 is exposed from the through hole 60*a* that is bored in the cover member 60.

Each nozzle 26 is linked to each ink flow path 57*a* which passes within the flow path forming portion 57, and each ink flow path 57*a* is linked to a plurality of supply pipe portions 55*a* which protrude upward from the upper surface of the flow path forming portion 57 through which a flow path that is not illustrated passes. Each supply pipe portion 55*a* is linked to a supply opening of the pressure adjustment unit 38 (refer to FIG. 1) that is mounted on the carriage 25 via the flow path that is not illustrated.

Accordingly, from each pressure adjustment unit 38 (refer to FIG. 1), ink of each corresponding color is supplied to the nozzle 26 of the corresponding recording head 67 through each supply pipe portion 55*a*, each ink flow path 57*a*, and the like. Note that, the liquid ejecting head 27 may be configured from one head which has a nozzle row of three or more rows.

Next, the configuration of the wiper unit 46 will be described in detail.

Figure 6:
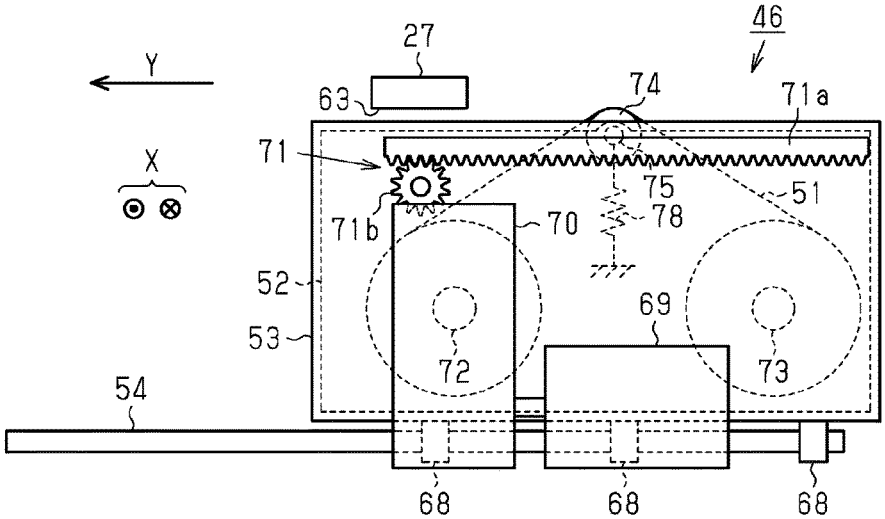
FIG. 6 is a schematic side-surface view of a wiper unit.

As shown in FIG. 6, the wiper unit 46 is provided with the wiper cassette 52 in which a cloth sheet 51 that is able to absorb ink that is adhered to the nozzle surface 63 is mounted on the by abutting on the nozzle surface 63 of the liquid ejecting head 27 and the wiper holder 53 in which the wiper cassette 52 is mounted so as to freely attach and detach. As an example of the cloth sheet 51 of the embodiment, a cloth sheet with a thickness of 0.34 mm to 0.41 mm is adopted.

The wiper unit 46 is guided along the pair of rail portions 54 via a guide portion 68 that is fixed to the lower portion, and is able to be reciprocally moved along the transport direction Y. An electric motor 69 which is a power source and a power transmission mechanism 70 which transmits power of the electric motor 69 are provided on the printer main body 16 (refer to FIG. 1) side.

A rack and pinion mechanism 71 is provided on a side portion of the wiper unit 46. The rack and pinion mechanism 71 has a rack gear portion 71*a* that is fixed to the side surface of the wiper holder 53 at an orientation at which a longitudinal direction matches the transport direction Y and a pinion gear portion 71*b* which meshes with the rack gear portion 71*a* and rotates at the transmitted power via the power transmission mechanism 70.

Then, when the electric motor 69 is driven to rotate forward, the pinion gear portion 71*b* rotates forward and the wiper unit 46 moves forward from a retreat position shown in FIG. 6 to the downstream side (left in FIG. 6) in the transport direction Y along with the rack gear portion 71*a*. When the electric motor 69 that has stopped after forward movement is subsequently driven in reverse, the pinion gear portion 71*b* which meshes with the rack gear portion 71*a* reverses, and the wiper unit 46 moves backward to the upstream side (right in FIG. 6) in the transport direction Y and returns to the retreat position shown in FIG. 6.

A feeding shaft 72 and a winding shaft 73 are axially supported within the wiper cassette 52 in a state of being separated by a predetermined distance in the transport direction Y. The unused cloth sheet 51 is supported on the feeding shaft 72 in a state of being wound, and the cloth sheet 51 that is spent is supported on the winding shaft 73 in a state of being wound by feeding from the feeding shaft 72. Note that, cleaning liquid (for example, water and the like) is pre-impregnated in order to improve a wiping property with respect to the nozzle surface 63 in the cloth sheet 51 that is unused. Of course, cleaning liquid may not be pre-impregnated in the cloth sheet 51, and the cleaning liquid may be coated before wiping the nozzle surface 63 in the cloth sheet 51 that is unused.

Figure 7:
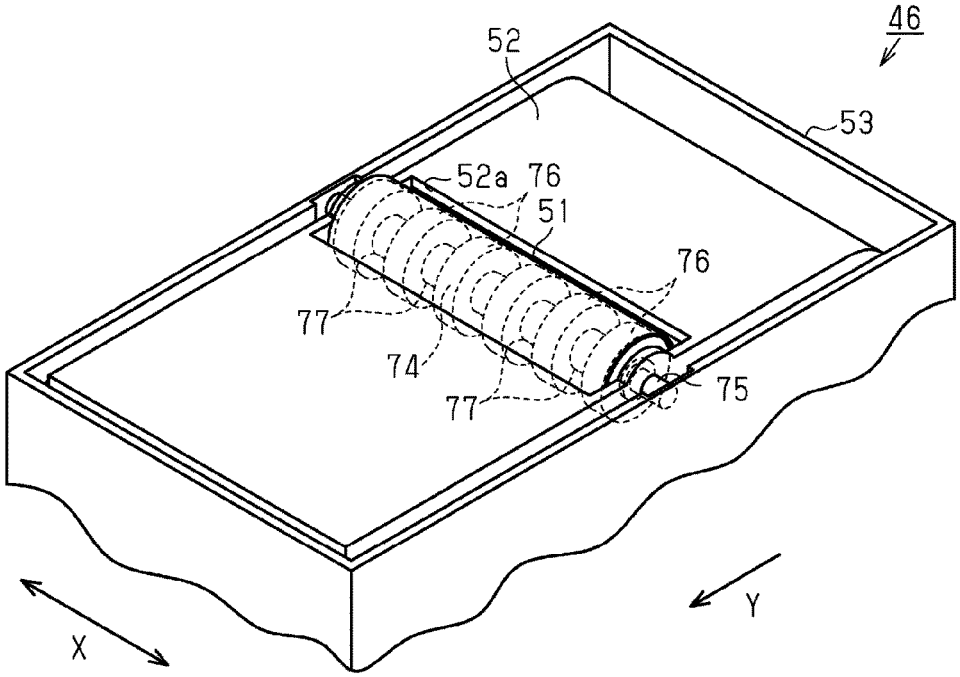
FIG. 7 is a perspective view illustrating a main portion of FIG. 6.

As shown in FIGS. 6 and 7, the cloth sheet 51 in the middle facing the winding shaft 73 by feeding from the feeding shaft 72 is wound around from the upper side on the outer peripheral surface of the pressing roller 74 as an example of the pressing portion of which a part protrudes upward from an opening portion 52*a* of a rectangular shape that is formed in an upper surface center portion of the wiper cassette 52.

The pressing roller 74 is provided with a support shaft 75 with a round bar shape, a plurality (six in the embodiment) of large diameter portions 76 with an annular form as an example of the convex portion that is formed so as to be equally spaced in an axis line direction on the peripheral surface of the support shaft 75, and a plurality (five in the embodiment) small diameter portions 77 with an annular form with a smaller outer diameter than the large diameter portion 76 that is formed between the large diameter portions 76 on the peripheral surface of the support shaft 75. Accordingly, the peripheral surface of the pressing roller 74 is configured by an uneven surface that forms a step. In this case, a difference (step difference of the peripheral surface of the pressing roller 74) of height from the peripheral surface of the support shaft 75 of each large diameter portion 76 and each small diameter portion 77 is set to 0.6 mm±0.1 mm in the embodiment.

For example, the support shaft 75 is configured by a hard material such as a metal or hard synthetic resin, and for example, each large diameter portion 76 and each small diameter portion 77 are configured by an elastic material such as rubber. Each large diameter portion 76 and each small diameter portion 77 are disposed alternately without a gap in the axis line direction of the support shaft 75, and are integrally formed. Then, in the support shaft 75, the pressing roller 74 is biased upward by a spring 78, and each large diameter portion 76 of the pressing roller 74 is in a state of pressing the cloth sheet 51 upward.

Accordingly, the pressing roller 74 is able to cause the cloth sheet 51 to contact the nozzle surface 63 by pressing the cloth sheet 51 from the opposite side to the side that contacts the nozzle surface 63 on the cloth sheet 51. In addition, the width of the cloth sheet 51 in the scanning direction X (axis line direction of the support shaft 75) is slightly wider the width of the nozzle surface 63 of the liquid ejecting head 27 in the scanning direction X. For this reason, it is possible to wipe the entirety of the nozzle surface 63 using the cloth sheet 51. Then, it is possible to adopt a material that is able to absorb and hold liquid (ink and cleaning liquid) with a weight ratio of 350% in the cloth sheet 51 of the embodiment.

In addition, in a state in which the wiper unit 46 is at a forward movement end position, for example, power transmission to the pinion gear portion 71*b* using a clutch mechanism (illustration omitted) within the power transmission mechanism 70 is blocked, and the winding shaft 73 is connected to the power transmission mechanism 70 to be able to transfer power. In this state, the winding shaft 73 rotates, the cloth sheet 51 that is unused is fed from the feeding shaft 72 and the cloth sheet 51 that is spent is wound by the winding shaft 73 due to power that is transmitted from the electric motor 69 via the power transmission mechanism 70.

At this time, the carriage 25 (refer to FIG. 2) retreats from the position at which the nozzle surface 63 of the liquid ejecting head 27 is wiped by the wiper unit 46. Then, after the wiping operation by the wiper unit 46 ends, when the electric motor 69 drives in reverse, the wiper unit 46 moves backward, and returns to the retreat position shown in FIG. 6.

Figure 8:
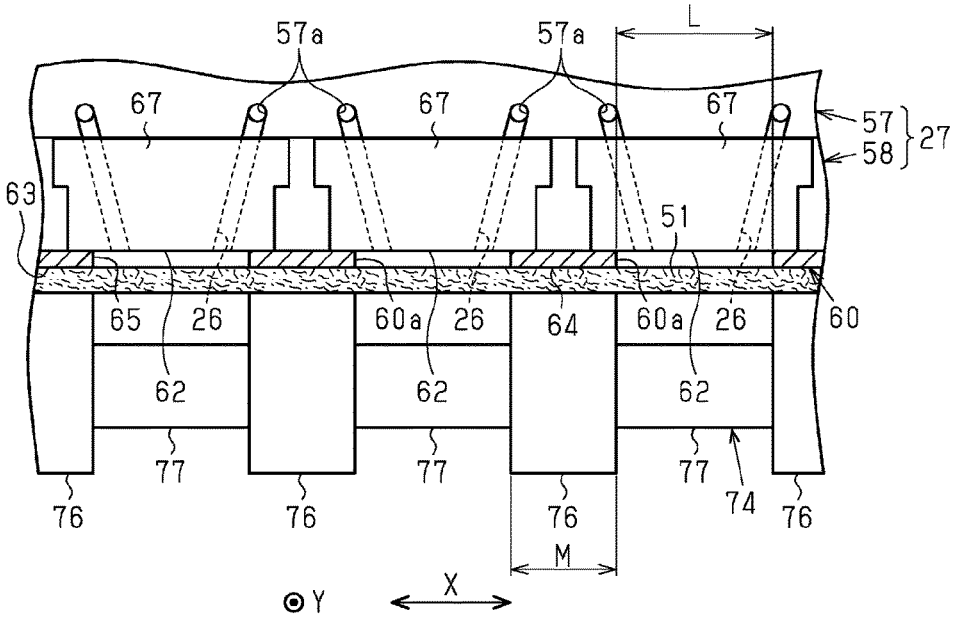
FIG. 8 is a schematic sectional view illustrating a second contact operation.

As shown in FIG. 8, a dimension M of the large diameter portion 76 in a direction that intersects with the direction which moves relatively to the liquid ejecting head 27 in a direction along the nozzle surface 63 in a state in which the cloth sheet 51 contacts the nozzle surface 63 is shorter than a dimension L of the nozzle region 62 in the intersection direction. That is, the dimension M of the large diameter portion 76 in the scanning direction X that is a direction that is orthogonal to the transport direction Y that is the movement direction when the cloth sheet 51 wipes the nozzle surface 63 is shorter than a dimension L of the nozzle region 62 in the scanning direction X.

In this case, it is preferable that the dimension L of the nozzle region 62 in the scanning direction X is slightly longer than the sum of a dimension of the large diameter portion 76 in the scanning direction X and a dimension that is equivalent to two times the thickness of the cloth sheet 51. In addition, the dimension L of the nozzle region 62 in the scanning direction X, the dimension of the through hole 60*a* in the scanning direction X, and the dimension of the small diameter portion 77 of the pressing roller 74 in the scanning direction X are the same. In the embodiment, the dimension L of the nozzle region 62 in the scanning direction X is set to 6.58 mm.

Furthermore, a dimension of a part that is interposed by each nozzle region 62 in the scanning direction X of the cover member 60, that is, a gap between each nozzle region 62 in the scanning direction X is the same as the dimension M of the large diameter portion 76 in the scanning direction X. Accordingly, six large diameter portions 76 in the pressing roller 74 are arranged in the scanning direction X such that the gap of the dimension L of the nozzle region 62 in the scanning direction X is open, and five nozzle regions 62 are arranged in the scanning direction X such that the gap by the dimension M of the large diameter portion 76 in the scanning direction X is open.

According to this configuration, a part that is wound around the large diameter portion 76 of the pressing roller 74 in the cloth sheet 51 is able to selectively press (cause to contact) with respect to the nozzle region 62 and the protrusion surface 64 (non-nozzle region) on the nozzle surface 63 by adjusting the position in the scanning direction X of the nozzle surface 63 and the large diameter portion 76 of the pressing roller 74 by moving the liquid ejecting head 27 side in the scanning direction X.

Figure 11:
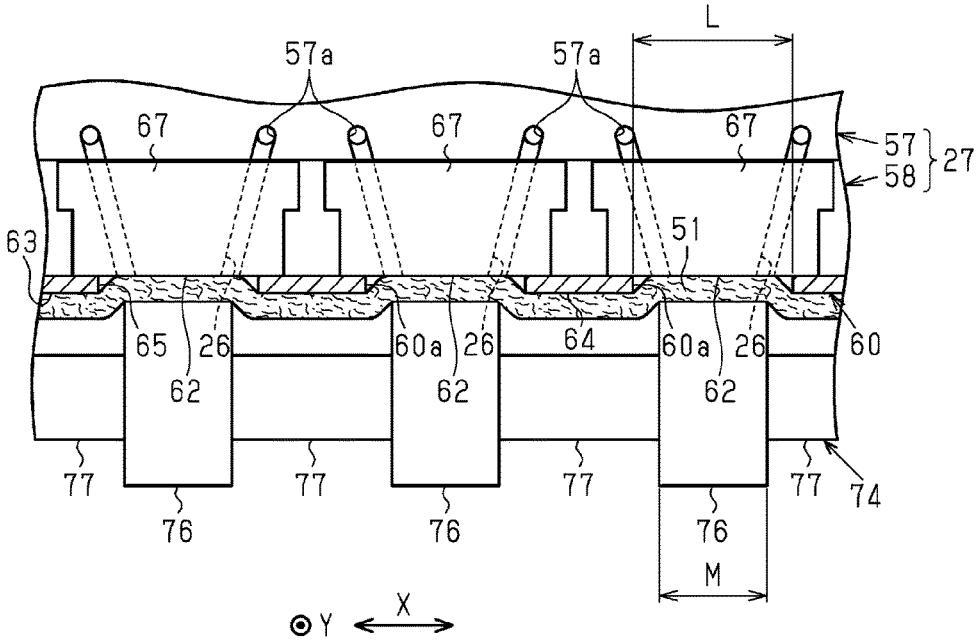
FIG. 11 is a schematic sectional view illustrating a first contact operation.

In this case, as shown in FIG. 11, the operation in which the cloth sheet 51 which is pressed by the large diameter portion 76 of the pressing roller 74 is caused to contact the nozzle surface 63 at a position which corresponds to the nozzle region 62 on the nozzle surface 63 is a first contact operation. Meanwhile, as shown in FIG. 8, the operation in which the cloth sheet 51 which is pressed by the large diameter portion 76 of the pressing roller 74 is caused to contact the nozzle surface 63 at a position which corresponds to the non-nozzle region (protrusion surface 64) that is a region outside of the nozzle region 62 on the nozzle surface 63 is a second contact operation.

Next, an action of the ink jet printer 11 will be described.

In the ink jet printer 11, printing on the recording medium 13 proceeds due to a printing operation in which recording by one scan is carried out on the recording medium 13 by ejecting an ink droplet from each nozzle 26 of the liquid ejecting head 27 in the middle of movement of the carriage 25 in the scanning direction X and a transport operation in which the recording medium 13 is transported up to a subsequent printing position being alternately repeated. During printing, the wiper unit 46 is in standby at the retreat position which is shown in FIG. 6.

Then, in the ink jet printer 11, at a predetermined timing (during replacement of the ink cartridge 30, during generation of an ejection defect of ink from the nozzle 26, prior to printing, and the like), ink within the liquid ejecting head 27 is discharged from the nozzle 26 by forcibly suctioning and head cleaning is performed. In a case where head cleaning is performed, first, after the carriage 25 and the liquid ejecting head 27 are moved to the home position HP at which the capping unit 48 is disposed due to driving of the carriage motor 24, the liquid ejecting head 27 is subjected to capping by the cap portion 47 by raising the cap portion 47 by driving the capping motor 49.

Next, when the inside of the cap portion 47 (closed space) is adsorbed by driving the suction pump 50, thickening of ink, air bubbles, and the like within the liquid ejecting head 27 are discharged from each nozzle 26 within the cap portion 47. At this time, since the inside of the cap portion 47 is in a state in which ink that is discharged from each nozzle 26 is filled, ink soaks into a region which corresponds to the inside of the cap portion 47 on the nozzle surface 63.

Then, when ink of a predetermined amount is discharged from each nozzle 26, the suction pump 50 is stopped. Next, when an air releasing valve (illustration omitted) which is provided in the cap portion 47 is open, air is released within the cap portion 47. Next, when the cap portion 47 is lowered by driving of the capping motor 49, the cap portion 47 is separated from the liquid ejecting head 27.

After that, ink which is residual within the cap portion 47 is discharged by the suction pump 50 being driven for a predetermined time and air suction being performed within the cap portion 47. Thereby, head cleaning is complete. After head cleaning is completed, since a region which corresponds to inside the cap portion 47 on the nozzle surface 63 is in a state of being wetted with plenty of ink, it is necessary to wipe the nozzle surface 63 to remove the ink using the wiper unit 46.

In this case, since the nozzle opening surface 61, that is, the nozzle region 62 is covered by the liquid repellent film 66, a small ink droplet (ink droplet smaller than the step 65 of 0.1 mm) that is adhered to the nozzle region 62 flows when the cap portion 47 is separated from the liquid ejecting head 27. For this reason, a state remains in which a large ink droplet (ink droplet larger than the step 65 of 0.1 mm) is adhered to the nozzle region 62.

Then, in a case where wiping of the nozzle surface 63 is performed by the wiper unit 46, first, the carriage 25 is moved to a position at which the nozzle surface 63 of the liquid ejecting head 27 is wiped using the wiper unit 46 by driving of the carriage motor 24. In this case, the carriage 25 is moved to a position at which contact with the cloth sheet 51 is possible by the second contact operation in which the cloth sheet 51 that is pressed by the large diameter portion 76 of the pressing roller 74 is caused to contact the nozzle surface 63 at a position which corresponds to the non-nozzle region (protrusion surface 64) that is a region outside of the nozzle region 62 on the nozzle surface 63.

Figure 9:
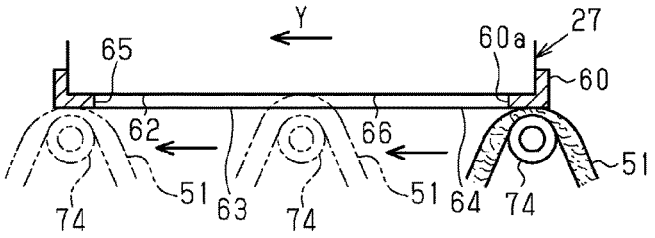
FIG. 9 is a schematic side-surface view illustrating a state of when the nozzle surface is wiped.
Figure 10:
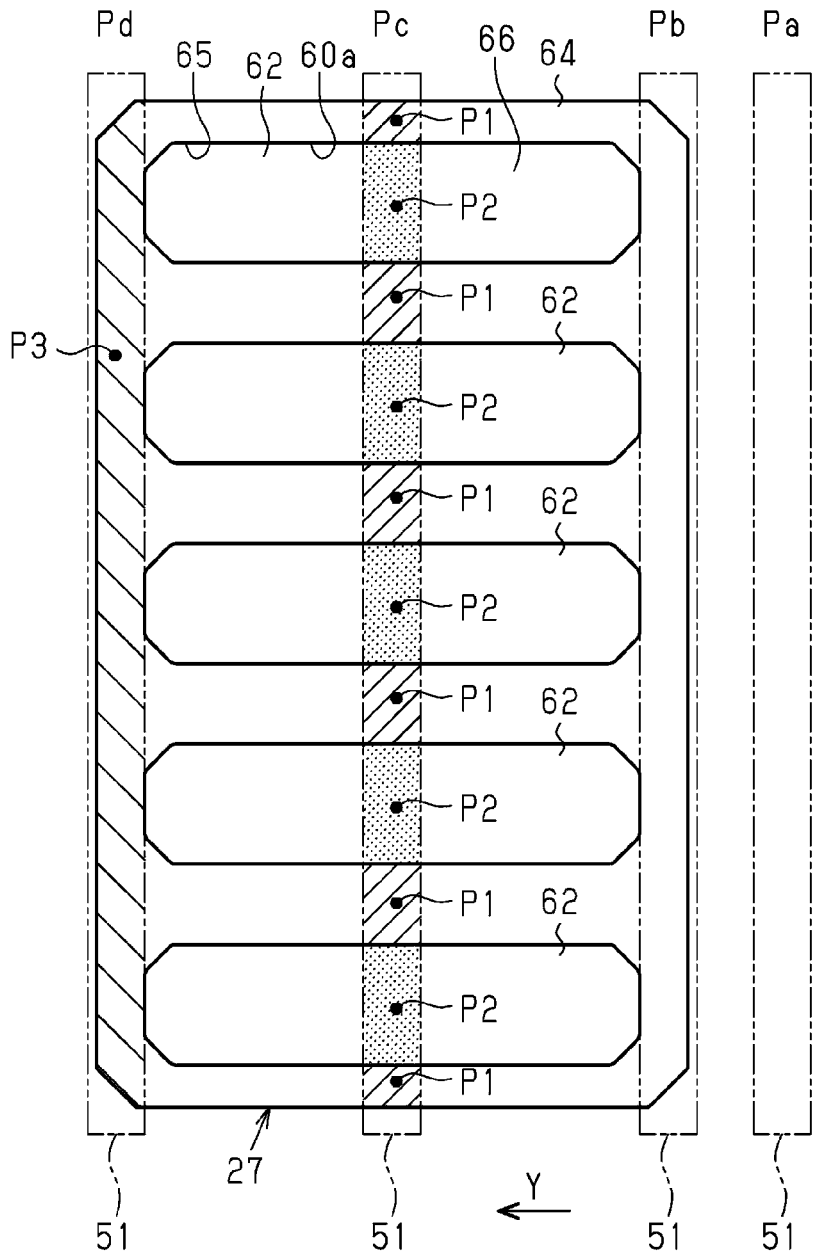
FIG. 10 is a schematic view illustrating a state of when the nozzle surface is wiped viewed from a nozzle surface side.

Next, as shown in FIGS. 9 and 10, when the wiper unit 46 is caused to move forward from the retreat position in the transport direction Y, the entirety of the nozzle surface 63 is wiped by moving the cloth sheet 51 in order of a Pa position, a Pb position, a Pc position, and a Pd position. At this time, since the part that is pressed on the large diameter portion 76 of the pressing roller 74 of the cloth sheet 51 is pressed at a relatively large pressure on the protrusion surface 64, adhered ink on the protrusion surface 64 is adsorbed to the cloth sheet 51, and is substantially reliably wiped away.

At this time, since a load on the pressing roller 74 is 3.43 N, and a contact area is 132.8 $mm^2$ when the pressing roller 74 elastically changes shape and contacts the cloth sheet 51, pressure is 25.8 kPa when the pressing roller 74 presses the cloth sheet 51 on the protrusion surface 64. Furthermore, at this time, since an amount of compression of the cloth sheet 51 is 0.07 mm to 0.08 mm when the cloth sheet 51 with a thickness of 0.34 mm to 0.41 mm is pressed on the protrusion surface 64 by the pressing roller 74, the thickness is 0.26 mm to 0.34 mm when the cloth sheet 51 wipes the protrusion surface 64.

Furthermore, at this time, as shown in FIG. 8, in the pressing roller 74, the part that corresponds to the through hole 60*a* is the small diameter portion 77, a part which corresponds to the nozzle region 62 of the cloth sheet 51 is barely pressed by the pressing roller 74, and the pressing roller 74 avoids pressing within the through hole 60*a* with a strong pressing force.

As a result, the part which corresponds to the through hole 60*a* in the cloth sheet 51 contacts the nozzle region 62 at smaller pressure than pressure (wiping pressure) at which the part that corresponds to the protrusion surface 64 in the cloth sheet 51 contacts the protrusion surface 64. That is, in the contact of the cloth sheet 51 by the second contact operation, the pressing force which is applied to the nozzle region 62 due to contact with the cloth sheet 51 is smaller than pressing force which is applied to the protrusion surface 64 (non-nozzle region) due to contact with the cloth sheet 51.

At this time, compressibility of the part that is pressed on the nozzle region 62 on the cloth sheet 51 is smaller than compressibility of the part that is pressed on the protrusion surface 64 (non-nozzle region) on the cloth sheet 51. Then, adhered ink on the nozzle surface 63 is absorbed to the cloth sheet 51 and wiped away by moving in the transport direction Y that is the wiping direction in a state in which the cloth sheet 51 contacts at pressures P1 and P2 that are shown at position Pc in FIG. 10.

Here, for example, when wiping is performed on the nozzle surface 63 using the cloth sheet 51 in contact with the cloth sheet 51 by the second contact operation, there are also cases where the cloth sheet 51 does not contact the nozzle region 62 at all, but since the size of the ink droplet that is adhered to the nozzle region 62 is the step 65 (0.1 mm) or more, even in such a case, the cloth sheet 51 reliably contacts the ink droplet which is adhered to the nozzle region 62. For this reason, the ink droplet that is adhered to the nozzle region 62 is removed by reliably absorbing using the cloth sheet 51.

In addition, in a case where wiping of the nozzle surface 63 is performed using the cloth sheet 51, since the particle of the pigment is present within ink that the cloth sheet 51 absorbs, when moved in a state in which the cloth sheet 51 during wiping abuts with strong pressure in the nozzle region 62, the nozzle region 62 receives damage due to the pigment particle functioning as an abrasive grain. When wiping in which such damage is received is repeatedly carried out and liquid repellence of the nozzle region 62 is lowered, there is a concern that curved flight of the ink droplet is caused leading to lowering of printing quality.

In this point, in the embodiment, ordinarily, as shown in FIG. 8, the nozzle surface 63 is wiped by the cloth sheet 51, that is, the cloth sheet 51 wipes the nozzle region 62 at a smaller pressure than pressure with respect to the protrusion surface 64 in contact with the cloth sheet 51 due to the second contact operation. For this reason, even if wiping of the nozzle surface 63 is repeatedly carried out due to contact with the cloth sheet 51 by the second contact operation, liquid repellence of the nozzle region 62 is difficult to lower. As a result, during printing, it is difficult to generate curved flight of the ink droplet which is ejected from each nozzle 26, and it is possible to print with high printing quality across a relatively long period.

Note that, since ink mist that is generated during printing is adhered to the nozzle surface 63, not only after head cleaning but also during printing, wiping of the nozzle surface 63 by the cloth sheet 51 is performed at a predetermined timing in contact with the cloth sheet 51 by the second contact operation.

In addition, as indicated by the position Pc in FIG. 10, in a region in which the cloth sheet 51 contacts both the nozzle region 62 and the protrusion surface 64 in the wiping operation in which the nozzle surface 63 is wiped by the cloth sheet 51, the cloth sheet 51 is moved in the transport direction Y in a state of contacting at the pressure P1 with respect to the protrusion surface 64 and contacting at the pressure P2 that is smaller than the pressure P1 with respect to the nozzle region 62. Then, after wiping of the region in which the cloth sheet 51 contacts both the nozzle region 62 and the protrusion surface 64 finishes, at the position Pd shown in FIG. 10 at which the cloth sheet 51 finally contacts the nozzle surface 63, the entirety of the last region that is a region to which the cloth sheet 51 on the nozzle surface 63 lastly contacts is the protrusion surface 64.

For this reason, the cloth sheet 51 changes from the pressure P2 that presses the nozzle region 62 up until then to a larger pressure P3. That is, in the contact of the cloth sheet 51 by the second contact operation, the pressing force which is applied to the last region on the nozzle surface 63 is larger than pressing force which is applied to the nozzle region 62 when the cloth sheet 51 contacts both the nozzle region 62 and the protrusion surface 64.

That is, when changing from a state in which the cloth sheet 51 contacts both the protrusion surface 64 and the nozzle region 62 to a state of contacting only the protrusion surface 64 of the last region, pressure on a part which contacts the nozzle region 62 on the cloth sheet 51 rises. For this reason, it is possible to suppress the cloth sheet 51 wiping away ink on the protrusion surface 64 of the last region.

In addition, since liquid repellence with respect to ink is low on the protrusion surface 64 in comparison to the nozzle region 62, adhered ink on the protrusion surface 64 tends to be relatively widely spread. For this reason, the ink on the protrusion surface 64 is effectively absorbed using a wide area of the cloth sheet 51. Incidentally, in a case where liquid repellence of the protrusion surface 64 is high in comparison to the nozzle region 62, ink which is moved from the nozzle region 62 to the protrusion surface 64 following the step 65 (inner wall surface of the through hole 60*a*) is not widely spread and is concentrated in the vicinity of the step 65.

For this reason, since ink is concentratedly absorbed in local area which corresponds to the step 65 on the cloth sheet 51, ink absorption performance of the area tends to be lowered, and ink not being wiped away tends to occur in the vicinity of the step 65. In this point, in the embodiment, since ink tends to be widely spread on the protrusion surface 64 that has lower liquid repellence than the nozzle region 62, ink that is widely spread is absorbed in a wide range by the cloth sheet 51. As a result, ink that is not wiped away tends not to occur in the vicinity of the step 65 on the nozzle surface 63.

In addition, rarely, there are cases where, for example, foreign matter such as fine fluff is adhered so as to pierce the nozzle region 62, but in such a case, it is not possible to remove the foreign matter by wiping the nozzle surface 63 in contact of the cloth sheet 51 due to the second contact operation. For this reason, in such a case, wiping of the nozzle surface 63 is performed due to contact with the cloth sheet 51 by the first contact operation.

In this case, first, the carriage 25 is moved to a position at which contact with the cloth sheet 51 is possible by the first contact operation in which the cloth sheet 51 that is pressed by the large diameter portion 76 of the pressing roller 74 is caused to contact the nozzle surface 63 at a position which corresponds to the nozzle region 62 on the nozzle surface 63. Next, as shown in FIGS. 9 and 10, when the wiper unit 46 is caused to move forward from the retreat position in the transport direction Y, the entirety of the nozzle surface 63 is wiped by moving the cloth sheet 51 in order of the Pa position, the Pb position, the Pc position, and the Pd position.

At this time, as shown in FIG. 11, the part that is pressed on the large diameter portion 76 of the pressing roller 74 of the cloth sheet 51 is pressed at a relatively large pressure on the nozzle region 62. In this case, since the dimension M of the large diameter portion 76 in the scanning direction X is shorter than the dimension L of the nozzle region 62 in the scanning direction X, the part that is pressed on the large diameter portion 76 on the cloth sheet 51 is reliably pressed on the nozzle region 62. As a result, the foreign matter on the nozzle region 62 is almost certainly wiped away along with the adhered ink.

In this manner, in the ink jet printer 11, it is possible to selectively perform wiping of the nozzle surface 63 by contacting the cloth sheet 51 due to the first contact operation and wiping of the nozzle surface 63 by contacting the cloth sheet 51 due to the second contact operation. In particular, frequency at which wiping of the nozzle surface 63 is performed by contacting the cloth sheet 51 due to the first contact operation is remarkably small in comparison to frequency at which wiping of the nozzle surface 63 is performed by contacting the cloth sheet 51 due to the second contact operation. For this reason, it is possible to suppress deterioration of the nozzle region 62 by wiping the nozzle surface 63.

According to the embodiment described above, it is possible to obtain the effects indicated below.

(1) The ink jet printer 11 is able to selectively perform wiping of the nozzle surface 63 by contacting the cloth sheet 51 due to the first contact operation and wiping of the nozzle surface 63 by contacting the cloth sheet 51 due to the second contact operation. For this reason, it is possible to perform wiping of the nozzle surface 63 while reducing pressing force which is applied to the nozzle region 62 due to wiping in particular, by selectively performing wiping of the nozzle surface 63 by contacting the cloth sheet 51 due to the second contact operation. Accordingly, it is possible to suppress deterioration of the nozzle region 62 which includes the opening region of the nozzle 26 by wiping the nozzle surface 63 on which the nozzle 26 that ejects ink is disposed.

(2) In the ink jet printer 11, in the contact of the cloth sheet 51 due to the second contact operation, the pressing force which is applied to the nozzle region 62 by contacting the cloth sheet 51 is smaller than pressing force which is applied to the protrusion surface 64 (non-nozzle region) by contacting the cloth sheet 51. For this reason, it is possible to appropriately absorb and remove ink which is adhered to the nozzle surface 63 while reducing damage that is applied to the nozzle region 62 using the cloth sheet 51.

(3) In the ink jet printer 11, compressibility of the part that is pressed on the nozzle region 62 on the cloth sheet 51 is smaller than compressibility of the part that is pressed on the protrusion surface 64 on the cloth sheet 51. For this reason, it is possible to appropriately absorb and remove ink which is adhered to the nozzle surface 63 while reducing damage that is applied to the nozzle region 62 using the cloth sheet 51.

(4) In the ink jet printer 11, the protrusion surface 64 has lower liquid repellence than the nozzle region 62. For this reason, it is possible to efficiently absorb and remove ink on the protrusion surface 64 using the cloth sheet 51 since ink tends to wet on the protrusion surface 64 on which liquid repellence is relatively low.

(5) In the ink jet printer 11, in the contact of the cloth sheet 51 by the second contact operation, the pressing force which is applied to the last region on the protrusion surface 64 is larger than pressing force which is applied to the nozzle region 62 when the cloth sheet 51 contacts both the nozzle region 62 and the protrusion surface 64. For this reason, when changing from a state in which the cloth sheet 51 contacts both the protrusion surface 64 and the nozzle region 62 to a state of contacting only the protrusion surface 64 of the last region, pressure on a part which contacts the nozzle region 62 on the cloth sheet 51 rises. Accordingly, it is possible to suppress the cloth sheet 51 not wiping away ink on the protrusion surface 64 of the last region.

(6) In the ink jet printer 11, a surface of the nozzle 26 on the liquid ejecting head 27 is covered by the cover member 60 that has the through hole 60*a* which exposes the nozzle region 62 in a part that corresponds to the nozzle region 62. For this reason, it is possible to apply pressing forces which are different from each other respectively in the nozzle region 62 and the protrusion surface 64 during wiping of the nozzle surface 63 with a relatively simple configuration in which the cover member 60 is attached to the liquid ejecting head 27.

(7) In the ink jet printer 11, the pressing roller 74 has the large diameter portion 76 which is able to press the cloth sheet 51, and the dimension M of the large diameter portion 76 in the scanning direction X is shorter than the dimension L of the nozzle region 62 in the scanning direction X. For this reason, in contact with the cloth sheet 51 due to the first contact operation, it is possible to effectively press the cloth sheet 51 using the large diameter portion 76 of the pressing roller 74 such that the cloth sheet 51 appropriately contacts the nozzle region 62.

Modification Examples

Note that, the embodiments may be modified as below.

Figure 12:
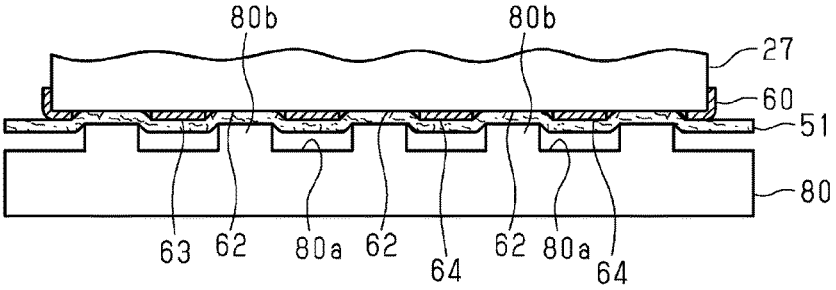
FIG. 12 is a schematic sectional view illustrating the first contact operation in a modification example.
Figure 13:
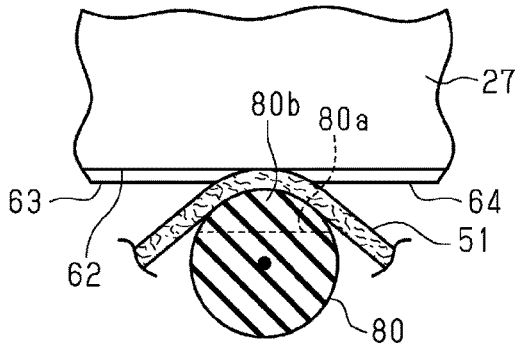
FIG. 13 is an enlarged sectional view of main portions of FIG. 12.
Figure 14:
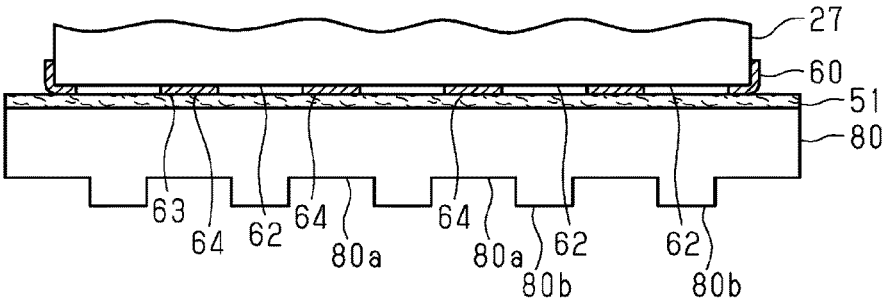
FIG. 14 is a schematic sectional view illustrating a second contact operation in the modification example.
Figure 15:
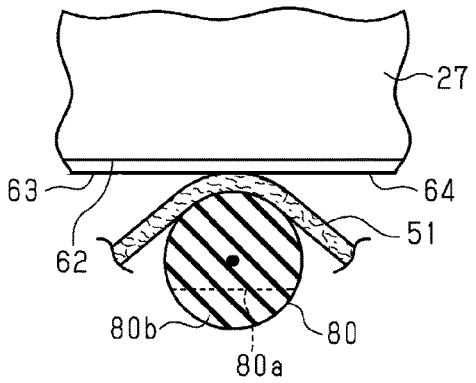
FIG. 15 is an enlarged sectional view of main portions of FIG. 14.

As shown in FIGS. 12 and 13, a rubber roller 80 may be used as the pressing portion in place of the pressing roller 74. The rubber roller 80 is formed by providing a plurality of concave portions 80*a* by cutting out a part which corresponds to the protrusion surface 64 of the nozzle surface 63 in a portion in the peripheral direction on the peripheral surface of rubber with a cylindrical shape. Accordingly, the concave portion 80*a* and the convex portion 80*b* are alternately formed in the axis line direction in the portion in the peripheral direction on the peripheral surface of the rubber roller 80. That is, concavities and convexities are formed in the portion in the peripheral direction on the peripheral surface of the rubber roller 80, and the part other than a part in which concavities and convexities are formed on the peripheral surface of the rubber roller 80 is not uneven and is flat. Then, as shown in FIGS. 12 and 13, in a case where wiping of the nozzle surface 63 is performed by contacting the cloth sheet 51 using the first contact operation, the cloth sheet 51 is pressed on the nozzle region 62 on the nozzle surface 63 by the convex portion 80*b* of the rubber roller 80. Meanwhile, in a case where wiping of the nozzle surface 63 is performed by contacting the cloth sheet 51 using the second contact operation, the rubber roller 80 is rotated, for example, by 180° from the state of the first contact operation (state shown in FIGS. 12 and 13) and as shown in FIGS. 14 and 15, the cloth sheet 51 is pressed on the protrusion surface 64 on the nozzle surface 63 by the flat part of the rubber roller 80.

Figure 16:
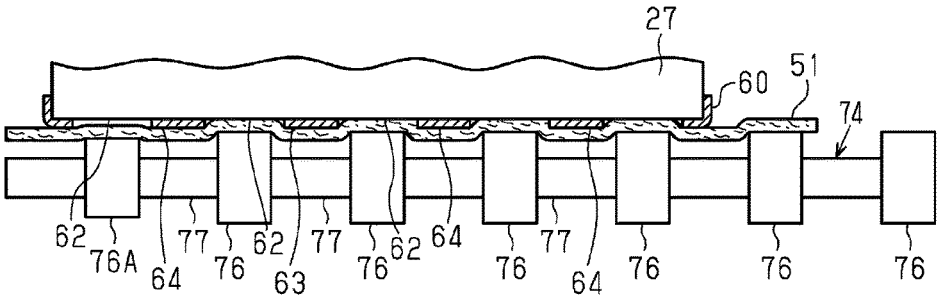
FIG. 16 is a schematic sectional view illustrating the first contact operation in another modification example.

As shown in FIG. 16, a small type large diameter portion 76A with a slightly smaller outer diameter than the large diameter portion 76 of the pressing roller 74 may be added to the end portion of the pressing roller 74. Then, in a case where wiping of the nozzle surface 63 is performed by contacting the cloth sheet 51 due to the first contact operation, the cloth sheet 51 is pressed by the small type large diameter portion 76A on the nozzle region 62 in which the nozzle row 59 that ejects ink which includes inorganic pigment such as carbon black or titanium oxide is formed. By doing this, during wiping of the nozzle region 62, it is possible to reduce damage that is applied to the nozzle region 62 using inorganic pigment. In addition, when performing wiping of the nozzle surface 63 by contacting the cloth sheet 51 due to the second contact operation, in a case where it is desired to reliably wipe the protrusion surface 64, it may be necessary to use the small type large diameter portion 76A. That is, it is sufficient if a position in the axis line direction of the pressing roller 74 is adjusted such that the cloth sheet 51 is pressed on the protrusion surface 64 by the large diameter portion 76 other than the small type large diameter portion 76A.

A soft large diameter portion with lower hardness than the large diameter portion 76 in the same shape as the large diameter portion 76 may be added to the end portion of the pressing roller 74. Then, in a case where wiping of the nozzle surface 63 is performed by contacting the cloth sheet 51 due to the first contact operation, the cloth sheet 51 is pressed by the soft large diameter portion on the nozzle region 62 in which the nozzle row 59 that ejects ink which includes inorganic pigment such as carbon black or titanium oxide is formed. By doing this, during wiping of the nozzle region 62, it is possible to reduce damage that is applied to the nozzle region 62 using inorganic pigment. In addition, when performing wiping of the nozzle surface 63 by contacting the cloth sheet 51 due to the second contact operation, in a case where it is desired to reliably wipe the protrusion surface 64, it may be necessary to use the soft large diameter portion. That is, it is sufficient if a position in the axis line direction of the pressing roller 74 is adjusted such that the cloth sheet 51 is pressed on the protrusion surface 64 by the large diameter portion 76 other than the soft large diameter portion.

Figure 17:
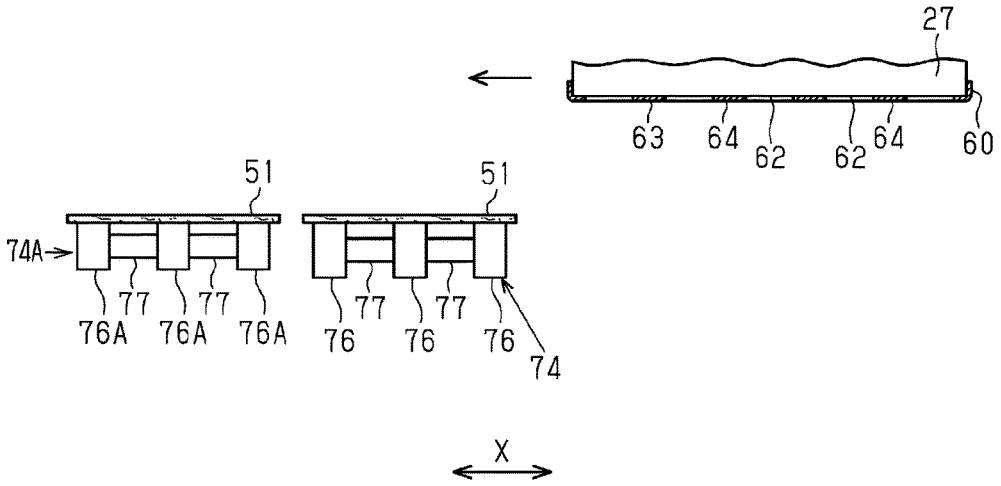
FIG. 17 is a schematic sectional view illustrating a configuration of when two types of different pressing rollers which respectively press a cloth sheet are adopted in yet another modification example.

As shown in FIG. 17, the wiper unit 46 which has the pressing roller 74 and a wiper unit in which the pressing roller 74 of the wiper unit 46 is modified to a small-type pressing roller 74A may be disposed lined up in the scanning direction X. In this case, the small-type pressing roller 74A is modified to the small type large diameter portion 76A in which the large diameter portion 76 of the pressing roller 74 has a slightly smaller outer diameter than the large diameter portion 76. Then, the wiper unit that has the small-type pressing roller 74A is used in a case where the nozzle region 62 is wiped in which the nozzle row 59 that ejects ink including inorganic pigment is formed, and the wiper unit 46 that has the pressing roller 74 is used in a case where the nozzle region 62 is wiped in which the nozzle row 59 that ejects ink not including inorganic pigment is formed.

Figure 18:
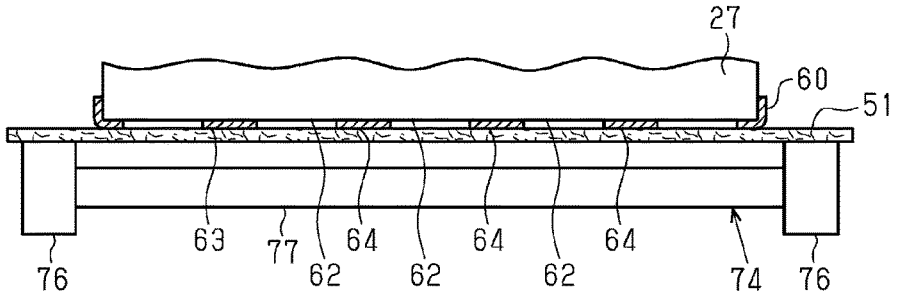
FIG. 18 is a schematic sectional view illustrating the second contact operation in still yet another modification example.

As shown in FIG. 18, in a case where wiping of the nozzle surface 63 is performed by contacting the cloth sheet 51 using the second contact operation, the large diameter portion 76 of the pressing roller 74 may press a region that is separated from the nozzle surface 63 in the cloth sheet 51. In this case, the large diameter portions 76 of the pressing roller 74 are disposed one at a time on both end portions, and a gap between the two large diameter portions 76 is slightly wider than a width of the nozzle surface 63.

Wiping of the nozzle surface 63 may be performed by a third contact operation in which the part that is not pressed by the pressing portion on the cloth sheet 51 is caused to contact the nozzle surface 63.

The pressing portion is not limited to a cylindrical shape, and may be configured by a member with a strip shape that has the convex portion. That is, for example, the pressing portion may be configured by a member in which the convex portion is formed on the surface on one side of a flat plate.

The dimension M of the large diameter portion 76 in the scanning direction X is not necessarily shorter than the dimension L of the nozzle region 62 in the scanning direction X.

The protrusion surface 64 does not use the cover member 60, and may be formed so as to be integrally formed in the liquid ejecting head 27. In this case, the nozzle opening surface 61 is configured by the uneven surface.

There may be a configuration in which the protrusion surface 64 is not provided, and liquid repellent treatment is carried out in an outside region that is adjacent to the opening region of the nozzle 26 on the nozzle opening surface 61 (region that is equivalent to the nozzle region 62 in the embodiment), and liquid repellent treatment is not carried out in the outside region (region that is equivalent to the non-nozzle region in the embodiment). In this case, the nozzle opening surface 61 corresponds to the nozzle surface 63 that is a target for wiping of the wiper unit 46 in the embodiment.

In the contact of the cloth sheet 51 by the second contact operation, it is not necessary that pressing force which is applied to the last region on the protrusion surface 64 is larger than pressing force which is applied to the nozzle region 62 when the cloth sheet 51 contacts both the nozzle region 62 and the protrusion surface 64.

Liquid repellence of the protrusion surface 64 is not necessarily lower than liquid repellence of the nozzle region 62.

In the contact of the cloth sheet 51 due to the second contact operation, it is not necessary that compressibility of the part that is pressed on the nozzle region 62 on the cloth sheet 51 is smaller than compressibility of the part that is pressed on the protrusion surface 64 on the cloth sheet 51.

In the contact of the cloth sheet 51 by the second contact operation, it is not necessary that the pressing force which is applied to the nozzle region 62 due to contact with the cloth sheet 51 is smaller than pressing force which is applied to the protrusion surface 64 (non-nozzle region) due to contact of the cloth sheet 51.

The liquid ejecting head 27 may perform head cleaning by capping each nozzle row 59. By doing this, since it is possible to set the cap portion to be small in comparison to a case in which head cleaning is performed by capping all nozzle rows 59 with the cap portion 47, it is possible to reduce the amount of ink consumed during head cleaning.

Cleaning liquid may not be pre-impregnated in the unused cloth sheet 51, a cleaning liquid coating mechanism such as an ejection nozzle may be provided, the cleaning liquid may be coated on the nozzle surface 63, and the nozzle surface 63 may be wiped by the cloth sheet 51.

Flushing may be performed by discharging ink with the object of elimination and the like of clogging of the nozzle 26 unrelated to printing from the nozzle 26 of the liquid ejecting head 27 in a region in which the cloth sheet 51 is spent in the wiper unit 46 (region in which the nozzle surface 63 is wiped).

Wiping of the nozzle surface 63 by the wiper unit 46 may be performed by moving the nozzle surface 63 in a state in which the wiper unit 46 is stationary, and may be performed by moving both the wiper unit 46 and the nozzle surface 63.

The ink jet printer 11 may not be provided with the carriage 25 which supports the liquid ejecting head 27, and may be a line head type which is provided with a line head with the printing range across the entire width of the recording medium 13. In this case, since the line head is fixed and does not move, the nozzle surface is wiped by moving the wiper unit.

Ink may be non-aqueous ink.

The non-aqueous ink will be described below.

The non-aqueous ink which is used in the liquid ejecting apparatus contains resin on the composition and does not substantially contain glycerin with a boiling point of 290° C. under one atmosphere. When the ink substantially includes glycerin, a drying property of ink is substantially lowered. As a result, in various mediums, in particular, a medium with an ink non-adsorption property or a low-adsorption property, not only is shade unevenness of an image conspicuous, but fixability of ink is not able to be obtained. Furthermore, it is preferable that ink does not substantially contain alkyl polyols (except for glycerin) in which the boiling point equivalent to under one atmosphere is 280° C. or more.

Here, "does not substantially contain" in the present specification has a meaning of not containing more than the amount at which the added meaning is sufficiently demonstrated. Quantitatively put, with respect to total mass (100 mass %) of ink, it is preferable that 1.0 mass % glycerin or more is not contained, it is further preferable 0.5 mass % glycerin or more is not contained, it is yet further preferable that 0.1 mass % glycerin or more is not contained, it is yet even further preferable that 0.05 mass % glycerin or more is not contained, and it is particularly preferable that 0.01 mass % glycerin or more is not contained. Then, it is most preferable that 0.001 mass % glycerin or more is not contained.

Next, matter contained in ink or additives (components) that are able to be contained will be described.

1. Color Material

Ink may contain color material. The color material is selected from pigment and dye.

1-1. Pigment

It is possible to improve light resistance of ink by using pigment as the color material. Pigment is able to use either of inorganic pigment and organic pigment. The inorganic pigment is not particularly limited, but, for example, carbon black, iron oxide, titanium oxide, and silica oxide are given.

The organic pigment is not particularly limited, but, for example, quinacridone pigment, quinacridonequinone pigment, dioxazine pigment, phthalocyanine pigment, anthrapyrimidine pigment, anthanthrone pigment, indanthrone pigment, flavanthrone pigment, perylene pigment, diketopyrrolopyrrole pigment, perinone pigment, quinophthalone pigment, anthraquinone pigment, thioindigo pigment, benzimidazolone pigment, isoindolinone pigment, azomethine pigment, and azo pigment are given. As specific examples of the organic pigment, the following are given.

As a pigment which is used in cyan ink, C.I. Pigment Blue 1, 2, 3, 15, 15:1, 15:2, 15:3, 15:4, 15:6, 15:34, 16, 18, 22, 60, 65, 66, and C.I. Bat Blue 4, and 60 are given. Above all, either of C.I. Pigment Blue 15:3 and 15:4 are preferable.

As a pigment which is used in magenta ink, C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, 264, and C.I. Pigment Violet 19, 23, 32, 33, 36, 38, 43, and 50 are given. Above all, one type or more which is selected from a group that is formed of C.I. Pigment Red 122, C.I. Pigment Red 202, and C.I. Pigment Violet 19 is preferable.

As a pigment which is used in yellow ink, C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 are given. Above all, one type or more which is selected from a group that is formed of C.I. Pigment Yellow 74, 155, and 213 is preferable.

Note that, as the pigment which is used in ink of color other than green ink, orange ink, or the like, well-known pigments are given.

Since average particle diameter of the pigment is able to suppress clogging in the nozzle and discharge stability is further improved, 250 nm or less is preferable. Note that, average particle diameter in the specification is a reference volume. For example, as a measurement method, it is possible to measure using a particle size distribution measuring device to which a laser diffraction scattering method is a measurement principle. For example, as the particle size distribution measuring device, a particle size distribution meter to which a dynamic light scattering method is a measurement principle (for example, a micro trac UPA manufactured by Nikkiso Co., Ltd.) is given.

1-2. Dye

It is possible to use pigment as the color material. The dye is not particularly limited, but it is possible to use an acid dye, a direct dye, a reactive dye, and a basic dye. Content of the color material is preferably 0.4 to 12 mass % and is more preferably 2 mass % to 5 mass % with respect to total mass (100 mass %) of ink.

2. Resin

The ink contains resin. Due to the ink containing resin, a resin coating is formed on the medium, and as a result, ink is sufficiently fixed on the medium and an effect is exhibited in which scratch resistance of the image is mainly favorable. For this reason, it is preferable that resin emulsion is a thermoplastic resin. Since it is possible to obtain an advantageous effect of clogging of the nozzle tending not to occur and scratch resistance of the medium being maintained, it is preferable that a heat distortion temperature of the resin is 40° C. or more, and 60° C. or more is more preferable.

Here, "heat distortion temperature" in the specification is a temperature value which is represented by glass-transition temperature (Tg) or a minimum film forming temperature (MFT). That is, "a heat distortion temperature of the resin is 40° C. or more" has a meaning that either Tg or MFT may be 40° C. or more. Note that, since MFT ascertains superior redispersal of resin to Tg, it is preferable that the heat distortion temperature is a temperature value which is represented by MFT. When the ink has superior redispersal of resin, the nozzle tends not to be clogged since the ink is not fixed.

Although not particularly limited, as specific examples of the thermoplastic resin, a poly (meth) acrylic acid ester or a copolymer thereof, a polyacrylonitrile or a copolymer thereof, a (meth) acrylic polymer such as a polycyanoacrylate, a polyacrylamide, and a poly (meth) acrylic acid, a polyethylene, a polypropylene, a polybutene, a polyisobutylene, and a polystyrene, and a copolymer thereof, as well as a polyolefin-based polymer such as a petroleum resin, a coumarone-indene resin, and a terpene resin, a polyvinyl acetate or a copolymer thereof, a vinyl alcohol such a polyvinyl alcohol, a polyvinyl acetal, and a polyvinyl ether or a vinyl alcohol polymer, a polyvinyl chloride or a copolymer thereof, a halogen-containing polymer such as a polyvinylidene chloride, a fluorine resin, and a fluoro rubber, polyvinyl carbazole, polyvinyl pyrrolidone or a copolymer thereof, a nitrogen-containing vinyl polymer such as a polyvinyl pyridine and a polyvinyl imidazole, a polybutadiene or a copolymer thereof, a diene polymer such as a polychloroprene and polyisoprene (butyl rubber), and well as another ring-opening polymerization type resin, a condensation polymerization type resin, and a natural polymer resin are given.

Content of the resin is preferably 1 to 30 mass % and is more preferably 1 to 5 mass % with respect to total mass (100 mass %) of ink. In a case where content is within the above range, it is possible to set further superior glossiness and scratch resistance of a formed overcoat image. In addition, as the resin which may be contained in the ink, for example, a resin dispersant, resin emulsion, wax, and the like are given.

2-1. Resin Emulsion

Ink may contain the resin emulsion. When the medium is heated, preferably the resin emulsion exhibits an effect of having favorable scratch resistance of the image by sufficiently fixing ink on the medium by forming the resin coating along with wax (emulsion). In a case where the medium is printed using ink that contains resin emulsion due to the above effect, in particular, ink has superior scratch resistance on the medium with the ink non-adsorption property or the low-adsorption property.

In addition, the resin emulsion which functions as a binder is contained within the ink that is in an emulsion state. In an ink jet recording method, viscosity of the ink tends to be adjusted within an appropriate range, and it is possible to increase storage stability and ejection stability of the ink by containing resin which functions as the binder within the ink in the emulsion state.

Although not particularly limited, as the resin emulsion, for example, a homopolymer of a (meth) acrylate, a (meth) acrylic acid ester, an acrylonitrile, a cyanoacrylate, an acrylamide, an olefin, a styrene, a vinyl acetate, a vinyl chloride, a vinyl alcohol, a vinyl ether, a vinyl pyrrolidone, a vinyl pyridine, a vinyl carbazole, a vinyl imidazole, and a vinylidene chloride, or a copolymer, a fluorocarbon resin, and a natural resin are given. Above all, either of a meth acrylic resin and a styrene methacrylic acid copolymer resin is preferable, either of an acrylic resin and a styrene-acrylic acid copolymer resin is more preferable, and the styrene-acrylic acid copolymer resin is further preferable. Note that, the copolymer may be formed of any of a random copolymer, a block copolymer, an alternating copolymer, and a graft copolymer.

In order to more favorably increase storage stability and ejection stability of ink, the average particle diameter of the resin emulsion is preferably in a range of 5 nm to 400 nm and more favorably in a range of 20 nm to 300 nm. Content of the resin emulsion within the resin is preferably within a range of 0.5 to 7 mass % with respect to total mass (100 mass %) of ink. When the content is within the above range, since it is possible to reduce solid concentration, it is possible to further favorably set the discharge stability.

2-2. Wax

Ink may contain wax. Fixability of ink on the medium with the ink non-adsorption property or the low-adsorption property is further superior due to the ink containing wax. Therein the wax is more preferably an emulsion type. Although not limited to the below, as the wax, for example, a polyethylene wax, a paraffin wax, and a polyolefin wax are given, and therein the polyolefin wax described later is preferable. Note that, in the specification "wax" mainly means using a surfactant described later and dispersing a fixed wax particle in water.

It is possible to set superior scratch resistance of ink by the ink containing a polyethylene wax. In order to more favorably set storage stability and ejection stability of ink, the average particle diameter of the polyethylene wax is preferably in a range of 5 nm to 400 nm and more favorably in a range of 50 nm to 200 nm.

Independently of each other, content (in terms of solid content) of the polyethylene wax is preferably in a range of 0.1 to 3 mass %, is more preferably in a range 0.3 to 3 mass %, and is even more preferably in a range 0.3 to 1.5 mass % with respect to total mass (100 mass %) of ink. When the content is within the above range, it is possible to favorably solidify and fix ink on the medium with the ink non-adsorption property or the low-adsorption property and it is possible to set further superior storage stability and ejection stability of ink.

3. Surfactant

Ink may contain surfactant. Although not limited to the following, as the surfactant, for example, a nonionic surfactant is given. The nonionic surfactant acts to uniformly spread ink on the medium. For this reason, in a case where printing is performed using ink which includes the nonionic surfactant, a high-definition image is obtained with almost no bleeding. Although not limited to the following, as such a nonionic surfactant, for example, silicon, polyoxyethylene alkyl ether, polyoxypropylene alkyl ether, polycyclic phenyl ether, sorbitan derivative, and fluorine surfactants are given, and therein, the silicon surfactant is preferable.

In order to more favorably set storage stability and ejection stability of the ink, content of the nonionic surfactant is preferably in a range of 0.1 to 3 mass % with respect to total mass (100 mass %) of ink.

4. Organic Solvent

Ink may contain a well-known volatile water soluble organic solvent. However, as described above, glycerin which is a type of organic solvent (boiling point under one atmosphere is 290° C.) is not substantially contained, and it is preferable that ink does not substantially contain alkyl polyols (except for glycerin) in which the boiling point equivalent to under one atmosphere is 280° C. or more.

5. Non-Proton Type Polar Solvent

The ink may contain a non-proton type polar solvent. Since the resin particles described above which are contained in the ink are dissolved by containing the non-proton type polar solvent in ink, it is possible to effectively suppress clogging of the nozzle when printing. In addition, since there is property in which the medium such as vinyl chloride is dissolved, adhesiveness of the image is improved.

Although not particularly limited, it is preferable that the non-proton type polar solvent includes one type of more which is selected from a pyrrolidone, a lactone, a sulfoxide, an imidazolidinone, a sulfolane, a urea derivative, a dialkyl amide, a cyclic ether, and an amide ether. As a representative example of the pyrrolidone, there are 2-pyrrolidone, N-methyl-2-pyrrolidone, and N-ethyl-2-pyrrolidone, as a representative example of the lactone, there are γ-butyrolactone, γ-valerolactone, and a ε-caprolactone, and as a representative example of the sulfoxide, there are dimethyl sulfoxide and tetramethylene sulfoxide.

As a representative example of the imidazolidinone, there is 1,3-dimethyl-2-imidazolidinone, as a representative example of the sulfolane, there are sulfolane and dimethyl sulfolane, and as a representative example of the urea derivative, there are dimethyl urea and 1,1,3,3-tetra-methyl urea. As a representative example of the dialkyl amide, there are dimethyl formamide and dimethyl acetamide, and as a representative example of the cyclic ether, there are 1,4-dioxane and tetrahydrofuran.

Therein, from the point of view of the effects described above, the pyrrolidone, the lactone, the sulfoxide, and the amide ether are particularly preferable, and 2-pyrrolidone is most preferable. Content of the non-proton type polar solvent is preferably in a range of 3 to 30 mass % and is more preferably in a range of 8 to 20 mass % with respect to total mass (100 mass %) of ink.

6. Other Components

The ink may further contain a fungicide, a rust inhibitor, a chelating agent, and the like in place of the components described above.

Next, the components of the surfactant which is mixed with a second liquid will be described.

As the surfactant, it is possible to use a cationic surfactant such as an alkylamine salt and a quaternary ammonium salt; an anionic surfactant such as a dialkyl sulfosuccinate salt, an alkylnaphthalene sulfonic acid salt, and a fatty acid salt; an amphoteric surfactant such as an alkyl dimethyl amine oxide and an alkylcarboxybetaine; a nonionic surfactant such as a polyoxyethylene alkyl ether, a polyoxyethylene alkyl allyl ether, an acetylene glycol, and a polyoxyethylene-polyoxypropylene block copolymer, and the like, and in particular therein, the anionic surfactant or the nonionic surfactant are preferable.

The content of the surfactant is preferably 0.1 to 5.0 mass % with respect to the total mass of the second liquid. Furthermore, from the point of view of foaming and defoaming after foaming, the content of the surfactant is preferably 0.5 to 1.5 mass % with respect to the total mass of the second liquid. Note that, the surfactant may be only one type, or may be two or more types. In addition, it is preferable that the surfactant that is contained in the second liquid is the same as the surfactant which is contained in the ink (first liquid), and for example, in a case where the surfactant that is contained in the ink (first liquid) is the nonionic surfactant, although not limited to the following, as the nonionic surfactant, for example, silicon, polyoxyethylene alkyl ether, polyoxypropylene alkyl ether, polycyclic phenyl ether, sorbitan derivative, and fluorine surfactant are given, and therein, the silicon surfactant is preferable.

In particular, since foam height immediately after foaming and five minutes after foaming that uses a Ross Miles method is set to be in a range (foaming height immediately after foaming is 50 mm or more, foaming height after five minutes is 5 mm or less), as the surfactant, it is preferable to use an adduct in which ethylene oxide (EO) is added to acetylene diol at a number of moles added of 4 to 30 and set the content of the adduct to 0.1 to 3.0 mass % with respect to the total weight of cleaning liquid. Furthermore, since foam height immediately after foaming and five minutes after foaming that uses the Ross Miles method is set to be in a preferable range (foaming height immediately after foaming is 100 mm or more, foaming height after five minutes is 5 mm or less), it is preferable to use an adduct in which ethylene oxide (EO) is added to acetylene diol at a number of moles added of 10 to 20 and set the content of the adduct to 0.5 to 1.5 mass % with respect to the total weight of cleaning liquid. However, when content of the ethylene oxide adduct of the acetylene diol is too great, there is a concern that the critical micelle concentration is reached and emulsification occurs.

The surfactant has a function of water-based ink tending to be spread on the recording medium. Although not particularly limited to the surfactant that is able to be used in the invention, it is possible to use an anionic surfactant such as a dialkyl sulfosuccinate salt, an alkylnaphthalene sulfonic acid salt, and a fatty acid salt; a nonionic surfactant such as a polyoxyethylene alkyl ether, a polyoxyethylene alkyl allyl ether, an acetylene glycol, and a polyoxyethylene-polyoxypropylene block copolymer; a cationic surfactant such as an alkylamine salt and a quaternary ammonium salt; a silicone surfactant; a fluorosurfactant; and the like.

Note that, there is an effect in which the surfactant subdivides and disperses an aggregate due to a surfactant effect between the cleaning liquid (second liquid) and the aggregate. In addition, since there is an operation in which surface tension of the cleaning liquid is lowered, there is an effect in which the cleaning liquid tends to infiltrate between the aggregate and the liquid ejection surface and the aggregate tends to be peeled from the liquid ejection surface.

If the surfactant is a compound that holds a hydrophilic portion and a hydrophobic portion within the same molecule, it is possible to appropriately use either. Preferable specific examples are represented below by Formulas (I) to (IV). That is, polyoxyethylene alkyl phenyl ether surfactant is given in Formula (I), acetylene glycol surfactant is given in Formula (II), polyoxyethylene alkyl ether surfactant is given in Formula (III), and polyoxyethylene polyoxypropylene alkyl ether surfactant is given in Formula (IV).

(I)

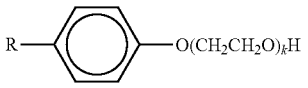

(R is a hydrocarbon chain that may be branched with a carbon number of 6 to 14, k: 5 to 20)

(II)

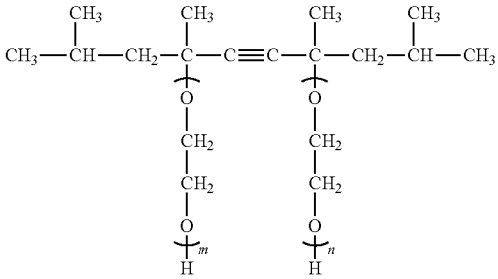

(m, n≤20, 0<m+n≤40)

$$R—(OCH_2CH_2)nH) \quad \text{(III)}$$

(R is a hydrocarbon chain that may be branched with a carbon number of 6 to 14, n: 5 to 20)

(IV)

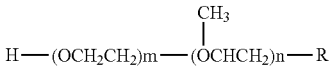

(R is a hydrocarbon chain with a carbon number of 6 to 14, m, n: 20 or less)

Other than the components in Equations (I) to (IV), for example, it is possible to use a diethylene glycol monophenyl ether, an ethylene glycol monophenyl ether, an ethylene glycol monoallyl ether, a diethylene glycol monophenyl ether, a diethylene glycol monobutyl ether, a propylene glycol monobutyl ether, a polyhydric alcohol alkyl and aryl ether such as petraethylene glycol chlorophenyl ether, a nonionic surfactant such as a polyoxyethylene polyoxypropylene block copolymer, a fluorosurfactant, and a lower alcohol such as ethanol and 2-propanol, and in particular, the diethylene glycol monobutyl ether is preferable.

In the embodiment, the liquid ejecting apparatus may be a liquid ejecting apparatus that ejects and discharges another liquid other than ink. Note that, the state of the liquid which is discharged in a liquid droplet in a very small amount from the liquid ejecting apparatus is set to include pulling out in a tail a granular shape, a tear shape, and a yarn shape. In addition, the liquid here may be a material that it is possible to eject from the liquid ejecting apparatus. For example, it is sufficient if the material is in a state of when a substance is in a liquid phase, and the material includes a fluid state body such as a liquid state body having high or low viscosity, a sol, a gel, and other materials such as an inorganic solvent, an organic solvent, a solution, a liquid state resin, and a liquid metal (molten metal). In addition, the state of the substance is not limited only to liquid, and a substance where particles of a functional material made from a solid substance such as a pigment or metallic particles are dissolved, dispersed, mixed, or the like in a solvent are included. As a representative example of the liquid body, various liquid compositions such as water-based ink, non-water-based ink, oil-based ink, gel ink, hot melt ink which are described in the embodiment described above, liquid crystal, or the like are given. As a specific example of the liquid ejecting apparatus, for example, there is a liquid ejecting apparatus which ejects liquid that includes a material such as an electrode material or a color material which is used in manufacture and the like of a liquid crystal display, an electro-luminescence (EL) display, a surface light emission display, and a color filter in a dispersed or dissolved form. In addition, the apparatus may be a liquid ejecting apparatus which ejects a bio-organic material that is used in biochip manufacture, a liquid ejecting apparatus which ejects liquid that is a sample that is used as a precision pipette, a textile printing apparatus, a micro dispenser, and the like. Furthermore, the apparatus may be a liquid ejecting apparatus which ejects lubricant oil with pinpoint precision in precision machinery such as a watch or a camera and a liquid ejecting apparatus which ejects a transparent resin liquid such as an ultraviolet curable resin on a substrate in order to form a micro-spherical lens (an optical lens) or the like which is used in an optical communication element or the like. In addition, the apparatus may be a liquid ejecting apparatus which ejects acidic or alkaline etching liquid in order to carry out etching on a substrate or the like.

This application is a continuation of U.S. patent application Ser. No. 15/238,081 filed on Aug. 16, 2016, which claims priority to Japanese Patent Application No. 2015-185755, filed Sep. 18, 2015, the entireties of which are hereby incorporated by reference herein.

What is claimed is:

1. A liquid ejecting apparatus comprising:

a liquid ejecting unit having a nozzle surface which comprises a nozzle opening surface and another nozzle opening surface, the nozzle opening surface including at least a nozzle group for ejecting a liquid containing an inorganic pigment and the another nozzle opening surface including at least another nozzle group for ejecting at least another liquid;

an absorption member absorbing the liquid and the other liquid adhered to the nozzle surface by contacting the nozzle surface; and a pressing portion pressing the absorption member from an opposite side from a side contacting the nozzle surface in the absorption member, the pressing portion pressing the absorption member toward the nozzle opening surface with a pressing force smaller than a pressing force for pressing the absorption member toward the another nozzle opening surface.

2. The liquid ejecting apparatus according to claim 1, further comprising a support portion supporting the pressing portion, wherein the pressing portion includes a first section for pressing the absorption member toward the nozzle opening surface and a second section for pressing the absorption member toward the another nozzle opening surface, the second section projecting more from the supporting portion than the first section.

3. The liquid ejecting apparatus according to claim 2, wherein the first section has a cylindrical shape, and the second section has a cylindrical shape having a larger diameter than the first section.

4. The liquid ejecting apparatus according to claim 1, wherein the pressing portion includes a first section for pressing the absorption member toward the nozzle opening surface and a second section for pressing the absorption member toward the another nozzle opening surface, the first section having lower hardness than the second section.

5. The liquid ejecting apparatus according to claim 4, wherein the first section has a cylindrical shape, and the second section has a cylindrical shape having a same diameter as the first section.

6. The liquid ejecting apparatus according to claim 1, wherein the nozzle surface further includes a non-nozzle region that is a region outside of the nozzle opening surface and the another nozzle opening surface, and wherein the liquid ejecting apparatus is configured to perform a first contact operation which causes the pressing portion to press the absorption member toward the nozzle opening surface and the another nozzle opening surface, and a second contact operation which causes the pressing portion to press the absorption member toward the non-nozzle region.

7. A cleaning device comprising:

an absorption member absorbing liquid adhered to a nozzle surface by contacting the nozzle surface of a liquid ejecting head which ejects the liquid, the nozzle surface comprising a nozzle opening surface which includes at least a nozzle group and another nozzle opening surface which includes at least another nozzle group; and a pressing portion supported by a supporting portion and pressing the absorption member from an opposite side from a side contacting the nozzle surface in the absorption member, the pressing portion includes a first section for pressing the absorption member toward the nozzle opening surface and a second section for pressing the absorption member toward the another nozzle opening surface, the second section projecting more from the supporting portion than the first section.

8. The cleaning device according to claim 7, wherein the first section is provided on an end portion side of the supporting portion from the second section.

9. The cleaning device according to claim 7, wherein the pressing portion further includes a third section separated from the absorption member when the first section presses the absorption member toward the nozzle opening surface and the second section presses the absorption member toward the another nozzle opening surface.

10. The cleaning device according to claim 9, wherein the first section projects more from the supporting portion than the third section.

11. The cleaning device according to claim 9, wherein the third section is disposed between the first section and the second section.

12. A cleaning device comprising:

an absorption member absorbing liquid adhered to a nozzle surface by contacting the nozzle surface of a liquid ejecting head which ejects the liquid, the nozzle surface comprising a nozzle opening surface which includes at least a nozzle group and another nozzle opening surface which includes at least another nozzle group; and a pressing portion pressing the absorption member from an opposite side from a side contacting the nozzle surface in the absorption member, the pressing portion includes a first section for pressing the absorption member toward the nozzle opening surface and a second section for pressing the absorption member toward the another nozzle opening surface, the first section having lower hardness than the second section.

13. The cleaning device according to claim 12, wherein the first section is provided on an end portion side of the supporting portion from the second section.

* * * * *